US006290472B2

(12) United States Patent
Gannaway

(10) Patent No.: US 6,290,472 B2
(45) **Date of Patent: *Sep. 18, 2001**

(54) ROTARY COMPRESSOR WITH VANE BODY IMMERSED IN LUBRICATING FLUID

(75) Inventor: Edwin L. Gannaway, Adrian, MI (US)

(73) Assignee: Tecumseh Products Company, Tecumseh, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/324,250

(22) Filed: Jun. 2, 1999

Related U.S. Application Data

(60) Provisional application No. 60/088,754, filed on Jun. 10, 1998.

(51) Int. Cl.[7] ..... F04B 23/04; F04B 39/02; F04C 18/356; F04C 29/02

(52) U.S. Cl. ..... 417/371; 418/60; 418/63; 418/96; 418/100

(58) Field of Search ..... 418/11, 60, 63, 418/96, 100; 417/410.3, 371

(56) References Cited

U.S. PATENT DOCUMENTS

| | | | | |
|---|---|---|---|---|
| 1,508,805 | | 9/1924 | Shaw et al. | 417/371 |
| 1,725,390 | * | 8/1929 | Brousse | 418/63 |
| 2,028,824 | | 1/1936 | Buchanan | 418/88 |
| 2,721,026 | * | 10/1955 | Dills | 418/63 |
| 3,003,684 | * | 10/1961 | Tarleton | 417/410.3 |
| 3,762,837 | | 10/1973 | Ellis et al. | 417/360 |
| 3,791,780 | | 2/1974 | Fritch et al. | 418/60 |
| 4,125,345 | | 11/1978 | Yoshinaga et al. | 417/243 |
| 4,456,437 | * | 6/1984 | Kurahayashi et al. | 417/410.3 |
| 4,592,705 | | 6/1986 | Ueda et al. | 418/63 |
| 4,971,529 | * | 11/1990 | Gannaway et al. | 418/60 |
| 5,007,813 | * | 4/1991 | Da Costa | 418/63 |
| 5,069,607 | | 12/1991 | Da Costa | 418/63 |
| 5,074,761 | | 12/1991 | Hirooka et al. | 417/310 |
| 5,098,266 | | 3/1992 | Takimoto et al. | 418/63 |
| 5,123,818 | | 6/1992 | Gormley et al. | 417/410 |
| 5,314,318 | | 5/1994 | Hata et al. | 418/60 |
| 5,328,344 | * | 7/1994 | Sato et al. | 418/60 |
| 5,545,021 | | 8/1996 | Fukuoka et al. | 418/63 |
| 5,616,018 | | 4/1997 | Ma | 418/63 |
| 5,685,703 | | 11/1997 | Fukuoka et al. | 418/63 |

FOREIGN PATENT DOCUMENTS

| | | | | |
|---|---|---|---|---|
| 4302392 | * | 1/1994 | (DE) | 418/60 |
| 0 671 562 A2 | | 9/1995 | (EP) . | |
| 0 569 119 B1 | | 5/1997 | (EP) . | |
| 61-155681 | | 7/1986 | (JP) . | |
| 2-191894 | | 7/1990 | (JP) . | |
| 4-94493 | * | 3/1992 | (JP) | 418/63 |
| 5-141376 | * | 6/1993 | (JP) | 418/63 |

* cited by examiner

*Primary Examiner*—John J. Vrablik
(74) *Attorney, Agent, or Firm*—Baker & Daniels

(57) ABSTRACT

A hermetic rotary compressor comprising a housing, a cylinder block and a bearing assembly in the housing and defining a cylindrical cavity therein. A roller piston, drivingly coupled to a motor, is disposed in the cylindrical cavity. The cylinder block includes a reciprocating vane within a vane slot defined therein. The vane slot extends axially through said cylinder block, radially from an outside perimeter surface of the cylinder block to the cylindrical cavity. At least a portion of the vane slot is defined by a pair of substantially parallel sidewalls with the vane disposed in the vane slot and urged against the roller piston. The vane is guided by the substantially parallel sidewalls and a clearance exists between the vane and the substantially parallel sidewalls. A pool of liquid lubricant is disposed within a sump defined by a discharge chamber and a lower portion of the vane and the clearance are immersed in the liquid lubricant, whereby the vane is lubricated and a refrigerant gas seal is established between the clearance and the vane.

8 Claims, 31 Drawing Sheets

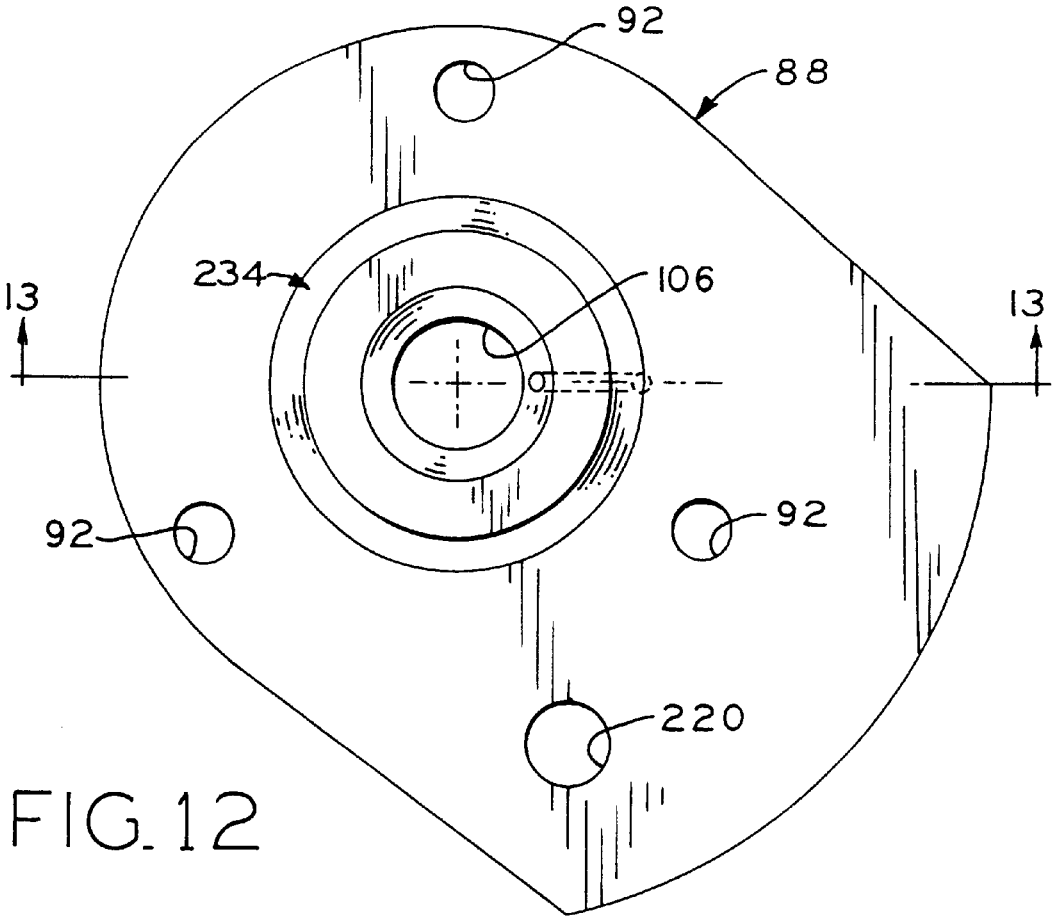
FIG. 12
FIG. 13
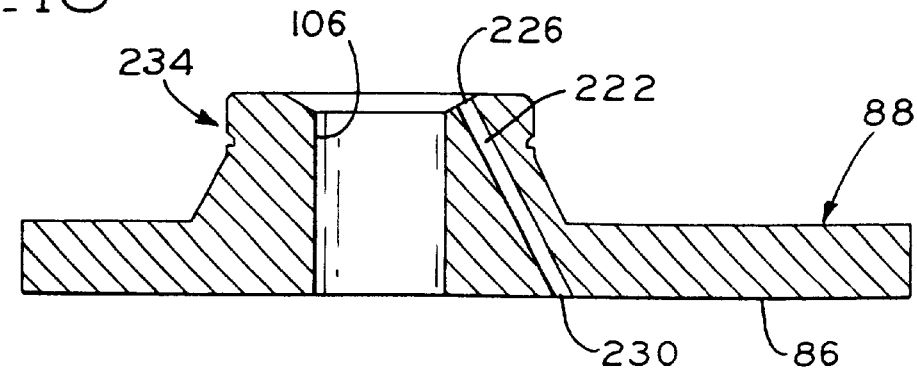

ROTARY COMPRESSOR WITH VANE BODY IMMERSED IN LUBRICATING FLUID

CROSS-REFERENCE TO RELATED APPLICATION

This application is related to and claims the benefit under 35 U.S.C. §119(e) of U.S. Provisional Application Ser. No. 60/088,754, filed Jun. 10, 1998.

BACKGROUND OF INVENTION

This invention pertains to hermetically sealed, positive displacement compressors for compressing refrigerant in refrigeration systems such as air conditioners, refrigerators and the like. In particular, the invention describes a rotary compressor mechanism, having a discharge chamber and a sump disposed therein and being of the type which includes a cylinder block having a cylindrical cavity, a bearing assembly and a motor assembly driving a roller piston disposed in the cylindrical cavity. More particularly, the cylinder block includes a vane slot, partially defined by a pair of vane slot sidewalls, extending completely axially through the cylinder block to accommodate a reciprocating vane therein and the vane being urged against a roller piston.

Rotary compressors are well known in the art, as exemplified by U.S. Pat. No. 4,889,475 which is assigned to assignee of the present application. Generally, the tolerances between the reciprocating vane and the slot sidewalls defining the vane slot of the cylinder block must be tightly controlled in order to optimize compressor efficiency. Proper vane clearances are necessary to allow free reciprocation of the vane in its slot and to allow sealing against discharge pressure gas blow-by therebetween. Maintaining these clearances in previous compressors often requires precision vane and/or slot machining, or select fitting of the individual vanes and cylinder blocks. A disadvantage arising from precision machining of the slot and/or vane is the associated cost of precision machining a pair of sidewalls defining the vane slot and vane. Always existent with precision machining is the immense cost associated with the act of "scrapping a part" when one of the final operations is spoiled due to a myriad of possible and easily made mistakes. A structure for easily providing a seal between the vane and their slot without resorting to costly and time consuming machining operations or select fitting is needed.

Generally, rotary compressor construction includes laboriously preparing the vane and vane slot for an introduction of the vane into the vane slot to provide a sealable fit therebetween when a lubricant is introduced therein. A disadvantage, already mentioned hereinabove, is that laboriously preparing components, through precision machining and the like, has an increased cost associated therewith. Components, such as the vane and vane slot satisfactorily sealing during operation, without the heretofore required precise machining of the vane and vane slot would be highly desirous.

Generally, rotary compressors heretofore disclosed include porting or journaling such that through suction of refrigerant gas, liquid lubricant in one portion of a compressor housing may be transferred to the cylinder block to fill the clearance between the vane and vane slot to provide a positive seal. A disadvantage of this type of lubrication is that liquid lubricant quantities vary and depend on the suction created by the compressor. Moreover, the scant amount of liquid lubricant "coating" the clearance between the vane and vane slot often acts to lubricate the clearance rather than seal it. A clearance which is sealed, and additionally lubricated, rather than merely being lubricated is highly desired.

SUMMARY OF THE INVENTION

The present invention overcomes the disadvantages of the prior art described above by providing a hermetically sealed twin rotary compressor assembly as herein described.

The present invention provides a hermetic compressor assembly including a housing, a cylinder block and bearing assembly within the housing, and additionally, the cylinder block and bearing assembly define a cylindrical cavity. A roller piston, disposed within the cylindrical cavity, is drivingly coupled to a motor. The cylinder block has a vane slot preferably extending completely axially through the cylinder block and extends radially from an outside perimeter surface of the cylinder block to the cylindrical cavity.

The present invention also provides a pair of sidewalls defining at least a portion of the vane slot in the cylinder block. A vane, guided by substantially parallel sidewalls, is disposed in the vane slot and is urged against the roller piston. A clearance exists between the vane and the substantially parallel slot walls. A sump disposed in the discharge chamber having a pool of liquid lubricant disposed therein. A lower portion of the vane and clearance is immersed in the liquid lubricant whereby the vane is lubricated and a refrigerant gas seal is established between the clearance and the vane.

BRIEF DESCRIPTION OF THE DRAWINGS

The above-mentioned and other features and objects of this invention, and the manner of attaining them, will become more apparent and the invention itself will be better understood by reference to the following description of the embodiments of the invention taken in conjunction with the accompanying drawings, wherein:

FIG. 12 is a front view of the front outboard bearing of the compressor assembly shown in FIG. 1;

FIG. 13 is a sectional side view of the outboard bearing of FIG. 12, along line 13—13 thereof;

Figure 1:
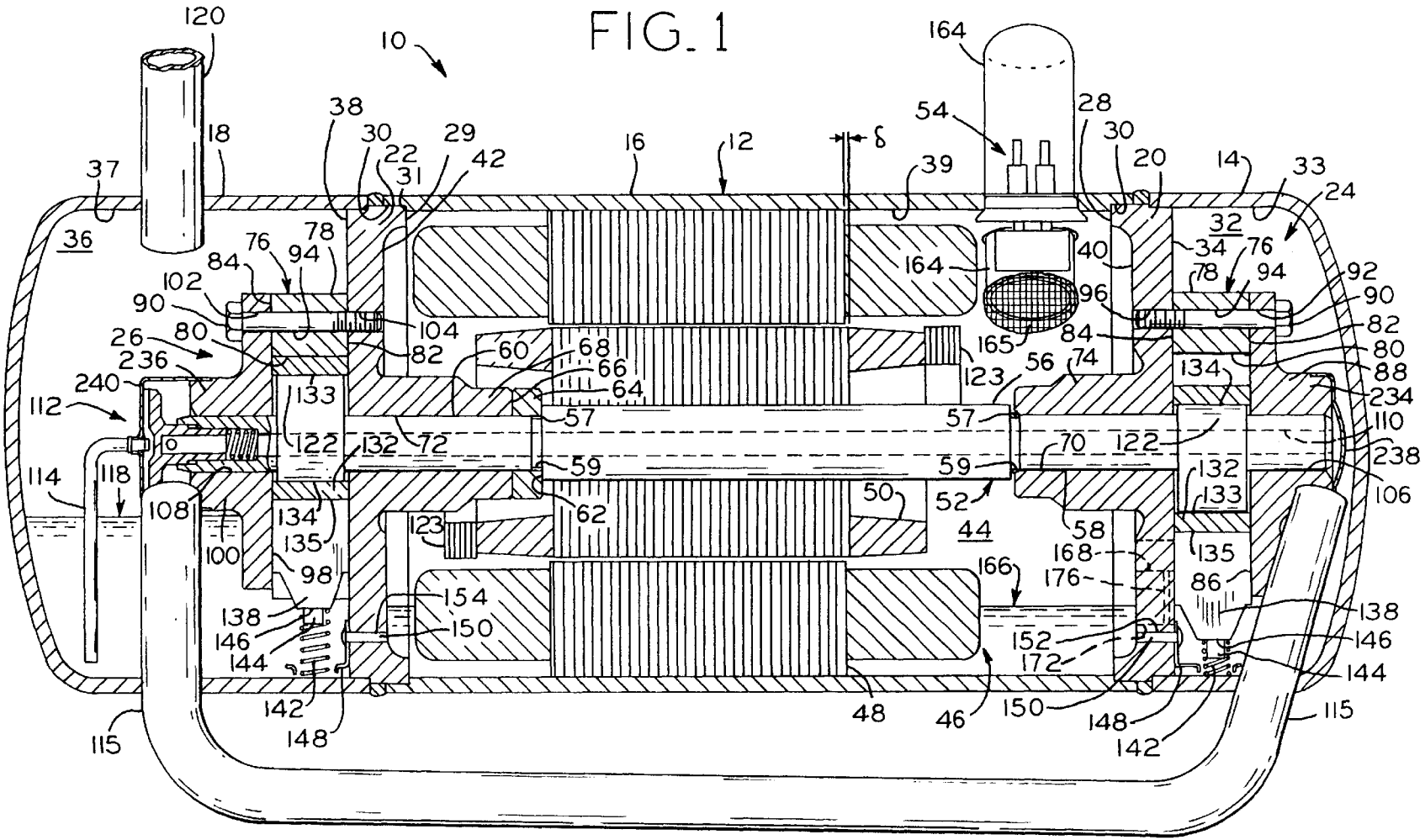
FIG. 1 is a sectional side view of one embodiment of a compressor assembly according to the present invention, also showing the cross-over tube fluidly connecting the two discharge chambers and the compressor assembly discharge tube.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in alternative forms, and such exemplifications are not to be construed as limiting the scope of the invention in any manner.

DETAILED DESCRIPTION OF THE INVENTION

The embodiments disclosed below are not intended to be exhaustive or limit the invention to the precise form disclosed in the following detailed description.

Referring to FIG. 1, there is shown twin rotary compressor assembly 10, a first embodiment according to the present invention. Compressor assembly 10 comprises housing 12 which is itself comprised of first housing portion 14, second, cylindrical housing portion 16 and third housing portion 18, first and third housing portions 14 and 18 being somewhat cup shaped, second housing portion 16 interposed between housing portions 14 and 18. Compressor assembly 10 further comprises front and rear main bearings 20, 22, respectively, which comprise, within housing portions 14 and 18, respective front and rear compressor mechanisms 24 and 26. As will be discussed further below, front main bearing 20 and rear main bearing 22 are mirror images of each other. Each of main bearings 20, 22 may be machined from a common casting or, alternatively, from a common sintered powder metal form. Main bearings 20 and 22 are respectively provided, at their peripheries, with annular, oppositely facing control surfaces 28 and 29. Control surfaces 28 and 29 lie in parallel planes which are perpendicular to the central axis of each main bearing. The forwardly and rearwardly facing axial surfaces of cylindrical second housing portion 16 are each provided with axial counterbore 30 concentric about the central axis of housing portion 16 and which provides annular shoulders 31 against which axial surfaces 28, 29 abut. Shoulders 31 lie in parallel planes which are perpendicular to the central axis of cylindrical housing portion 16 and provide control surfaces for proper axial spacing and radial alignment of main bearings 20, 22, and ensure they fit squarely within housing portion 16. Proper placement of main bearings 20, 22 allows the shaft supported thereby to be properly journaled and assures proper clearances are provided between the moving components which comprise front and rear compressor mechanisms 24, 26. The mating axial ends of housing portions 14, 16 and 18 are joined at the outer radial periphery of respective main bearings 20, 22, to which they are sealably attached, as by welding. Welding each of housing portions 14, 16 and 18 to the main bearings separates housing 12 into three distinct internal chambers separated by the main bearings. Front chamber 32 is generally defined by inside surface 33 of housing portion 14 and forward facing axial surface 34 of main bearing 20. Similarly, rear chamber 36 is defined by inside surface 37 of third housing portion 18 and rearward facing axial surface 38 of rear main bearing 22. As will be discussed further below, chambers 32 and 36 contain refrigerant gas at discharge pressure, and are also referred to hereinafter as front and rear discharge chambers, respectively. Intermediate main bearings 20 and 22 and generally defined by inside cylindrical surface 39 of center housing portion 16 and surfaces 40 and 42 of front and rear main bearings 20 and 22, respectively, is chamber 44. Chamber 44, as will be discussed further below, contains refrigerant gas at suction pressure, and is hereinafter referred to as suction chamber 44. Within suction chamber 44 is disposed motor assembly 46 comprising stator 48 in surrounding relationship with rotor 50. Shaft 52 extends through the center of rotor 50, and is attached thereto to be driven by rotor 50 when motor assembly 46 is energized through terminals 54, which electrically communicate the motor with an external source of power. Providing the motor in the suction chamber provides a cooler operating environment for it, promoting its efficient operation and prevents its overheating. Further, placement of the motor assembly in the relatively cool environment of the suction chamber provides for easier identification of an internal motor over-temperature condition vis-a-vis compressors having motors exposed to discharge pressure, for the temperature protection device (not shown) attached to the stator windings, which interrupts electrical current to the motor when it becomes overheated, need not be calibrated to operate in relatively narrow temperature difference ranges between discharge gas temperatures to which the motor is ordinarily exposed and the motor over-temperature point.

Shaft 52 comprises large diameter central portion 56, which extends through rotor 50, and forwardly and rearwardly extending small diameter portions 58 and 60, respectively, adjacent portion 56. At the juncture of shaft portion 56 with shaft portions 58 and 60, shaft 52 is provided with annular groove 57 in which may be disposed oil seal 59 which may be made of a material such as Teflon® or Ryton® and past which some leakage is permissible. Annular shoulder 62 is formed on the axial surface of shaft large diameter portion 56, at its juncture with groove 57. Thrust washer 64 is disposed about small diameter shaft portion 60, with its forwardly and rearwardly facing axial surfaces abutting shaft shoulder 62 and forward facing axial surface 66 of hub portion 68 of rear main bearing 22. Motor assembly 46 is arranged such that the windings of stator 48 and rotor 50 are axially offset by distance 6. Upon energization of stator 48, rotor 50 not only rotates but is also urged rearward as it attempts to axially align its windings with those of the stator. Rotor 50 thus exerts a rearward axial force on shaft 52 which is transferred through shoulder 62 to thrust bearing 64 and opposed by main bearing 22. In this way, axial surfaces of the eccentrics and adjacent bearings are not brought into abutment and caused to carry an axial load. Small diameter shaft portions 58 and 60 are respectively journaled in main bearing journals 70 and 72, which extend through main bearing hub portions 74 and 68.

Front compressor mechanism 24 and rear compressor 26 are each provided with cylinder block 76. Cylinder block 76 comprises outer peripheral surface 78 and inner cylindrical cavity 80. Cylindrical cavity 80 extends through the width of cylinder block 76 between its forward and rearwardly facing parallel axial surfaces 82 and 84, respectively. In front compressor mechanism 24, cylinder block rearward surface 84 abuts forwardly facing axial surface 34 of main bearing 20. Similarly, in rear compressor mechanism 26, cylinder block forward surface 82 abuts rearwardly facing main bearing axial surface 38. Thus it can be seen that cylinder blocks 76 are similarly oriented about shaft 52 in front and rear compressor mechanisms 24, 26.

In front compressor mechanism 24, forward cylinder block surface 82 abuts rearwardly facing axial surface 86 of front outboard bearing 88. Outboard bearing 88, frontmost cylinder block 76 and front main bearing 20 are attached by a plurality of bolts 90 extending through bolt holes 92, 94 and 96, with bolts 90 threadedly engaging main bearing bolt holes 96. In rear compressor mechanism 26, rearward cylinder block surface 84 abuts forwardly facing axial surface 98 of rear outboard bearing 100. As described above, a plurality of bolts 90 attaches outboard bearing 100, rearmost cylinder block 76 and rear main bearing 22, extending through bolt holes 102, 94 and 104 provided therein, threadedly engaging main bearing bolt holes 104. Small diameter shaft portions 58 and 60 extend through outboard bearings 88 and 100, and are supported in respective journals 106 and 108 provided therein. As will be discussed further below, front outboard bearing 88 and rear outboard bearing 100 are mirror images of one another, and may be machined together or on common tooling from identical castings or sintered powder metal forms.

Shaft 52 is provided with axial bore 110 which extends completely through its length. At its rearmost end, bore 110 is provided with impeller-type pump assembly 112 of a type commonly used in the art. Pump assembly 112 draws liquid lubricant from the lowermost portion of rear discharge chamber 36, which serves as a sump, through vertical lubricant draw conduit or tube 114, which extends downwardly from pump assembly 112. The lowermost portion of front discharge chamber 32 also contains a quantity of liquid lubricant, also referred to as oil, as may that of suction chamber 44. Pump assembly 112 provides oil through bore 110 to rear compressor mechanism 26 and to front compressor mechanism 24 for lubrication thereof, as will be discussed further below.

Figure 3:
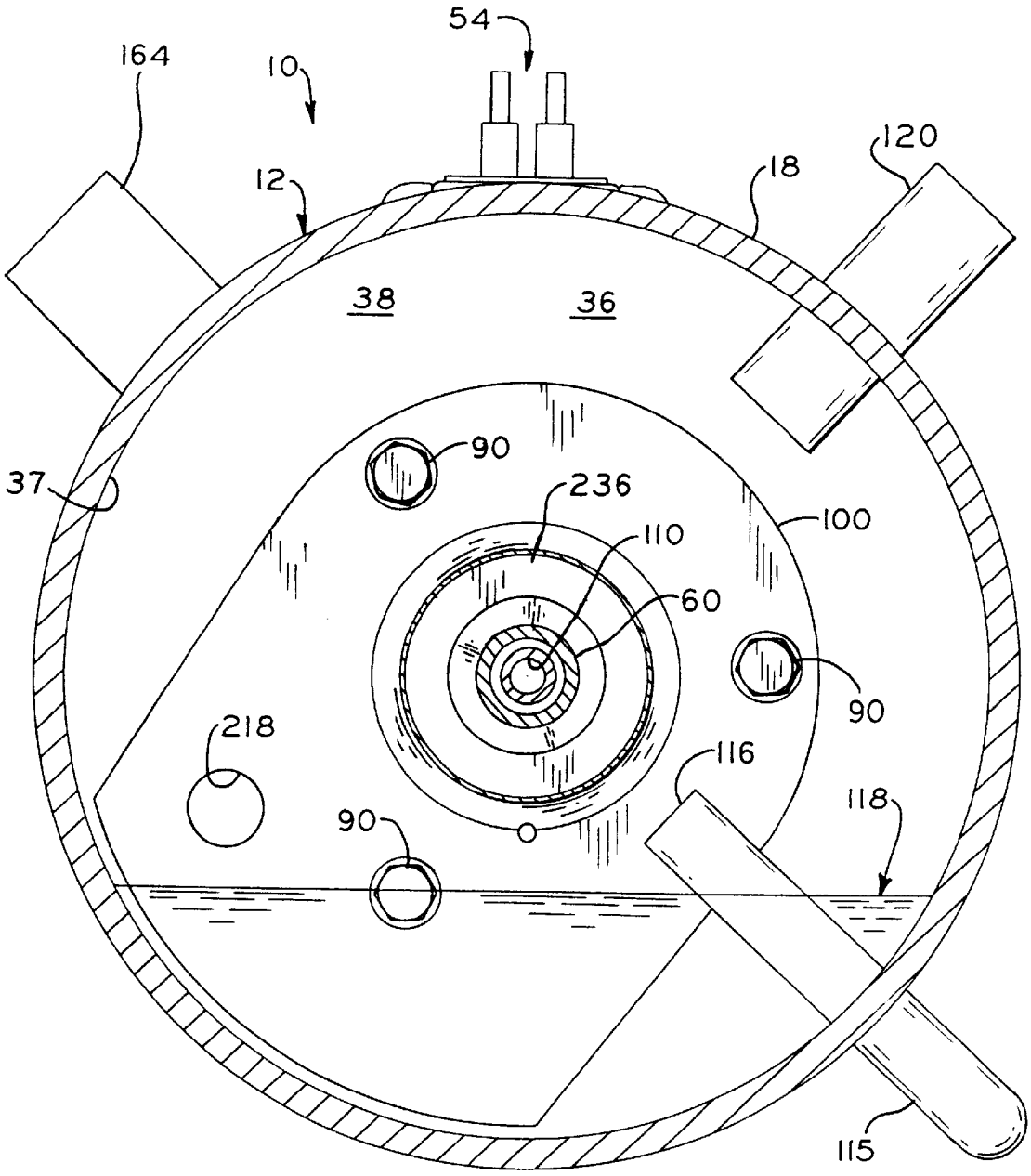
FIG. 3 is a sectional rear view of the compressor assembly shown in FIG. 2, taken along line 3—3 thereof.
Figure 4:
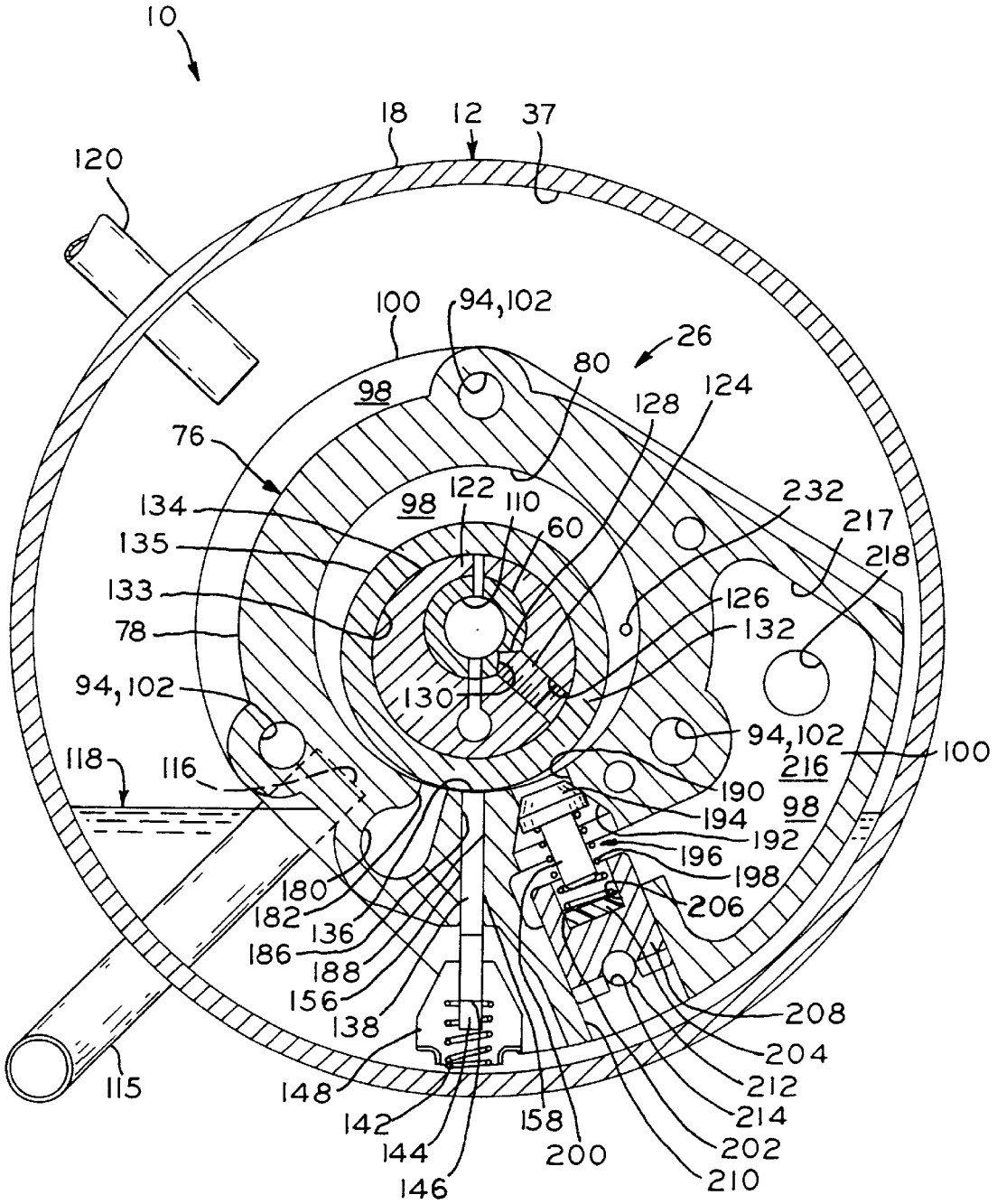
FIG. 4 is a sectional front view of the compressor assembly shown in FIG. 2, taken along line 4—4 thereof.
Figure 6:
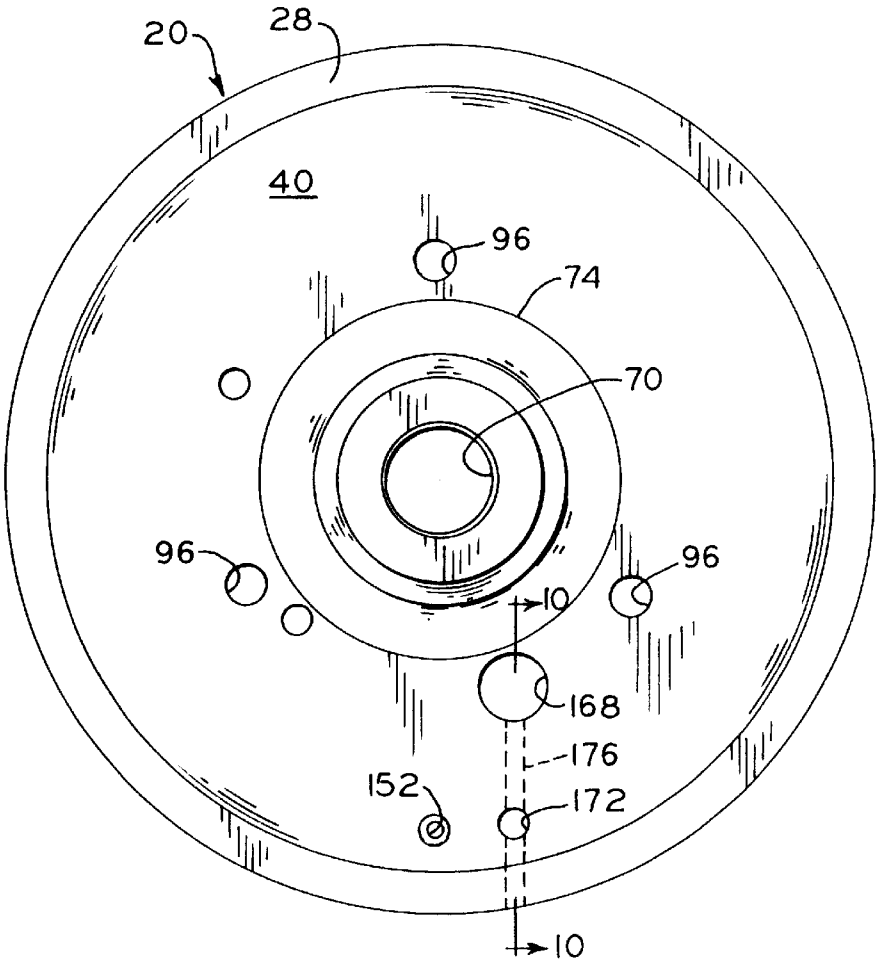
FIG. 6 is a rear view of the main bearing shown in FIG. 5.
Figure 5:
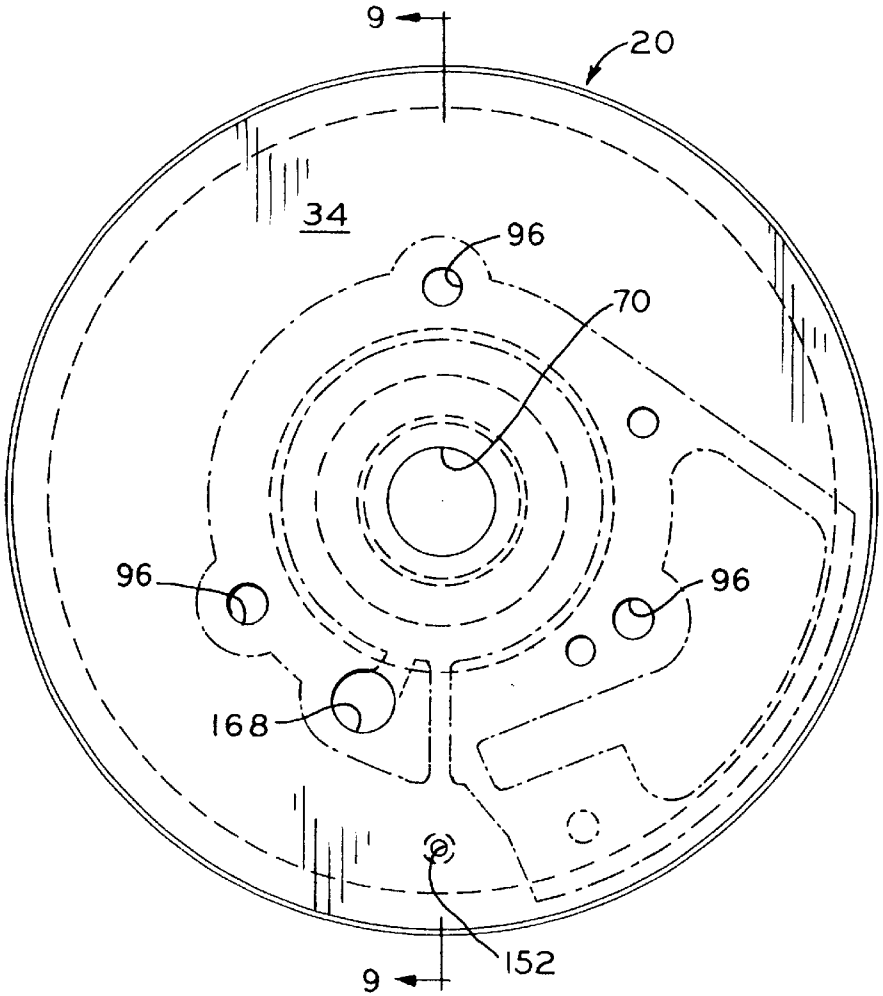
FIG. 5 is a front view of the front main bearing of the compressor assembly shown in FIG. 1, including the outline of the cylinder block location on the axial main bearing surface.
Figure 8:
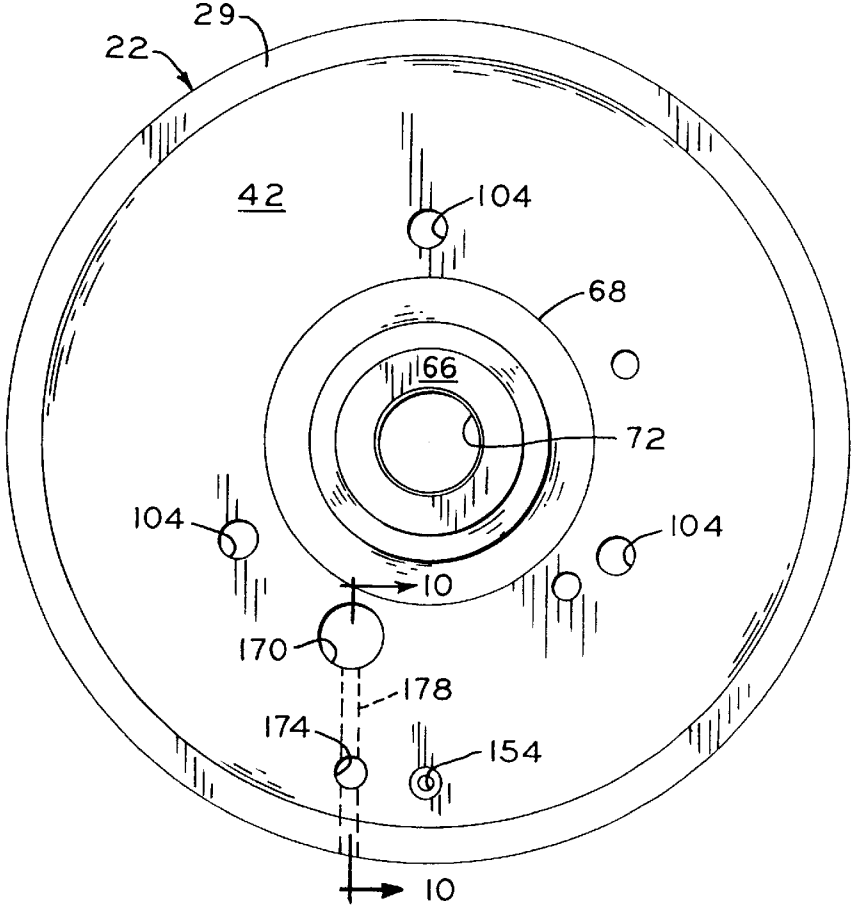
FIG. 8 is a front view of the main bearing shown in FIG. 7.
Figure 7:
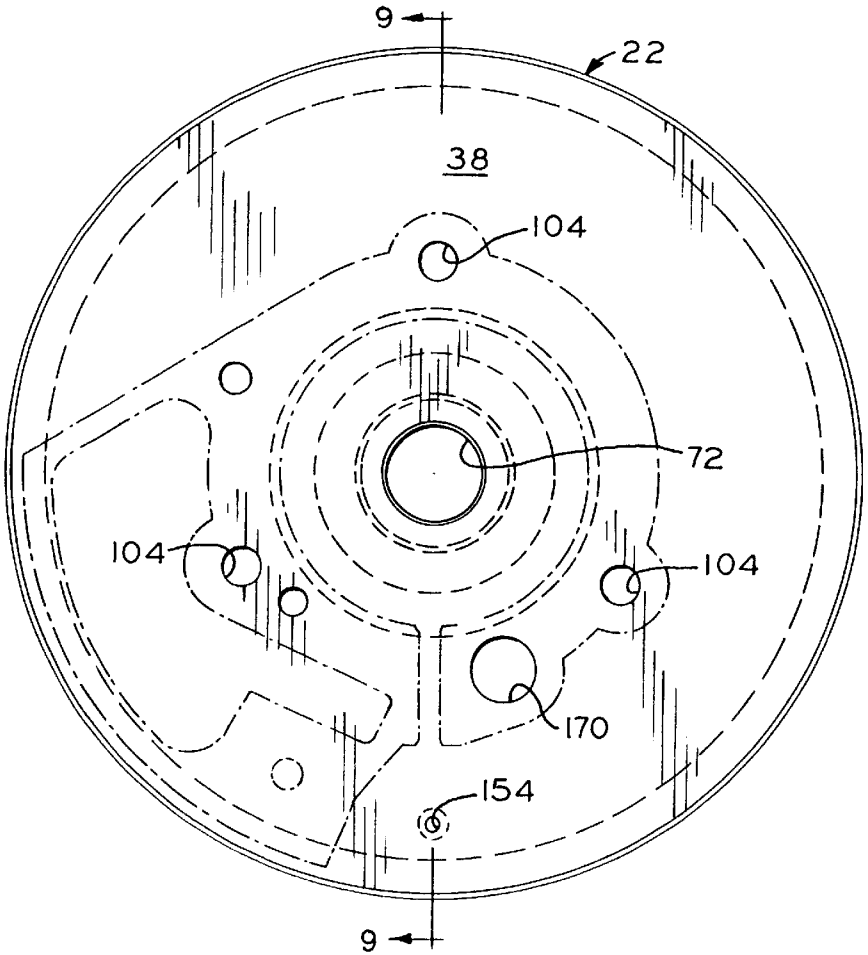
FIG. 7 is a rear view of the rear main bearing of the compressor assembly shown in FIG. 1, including the outline of the cylinder block location on the axial main bearing surface.
Figure 9:
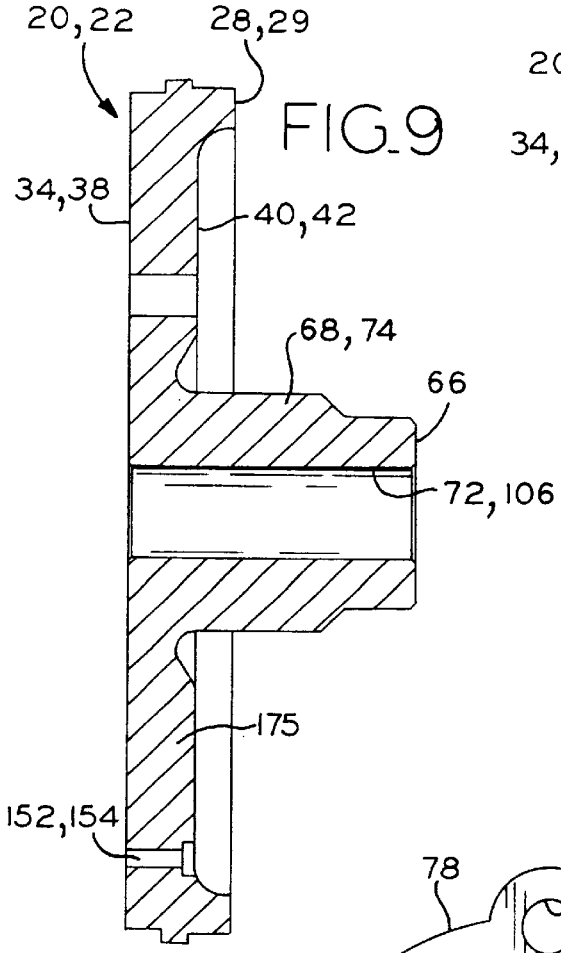
FIG. 9 is sectional side view of each of the main bearings shown in FIGS. 5 and 7, along lines 9—9 thereof.

Discharge chambers 32 and 36 are in fluid communication with one another by means of external cross-over discharge conduit in the form of a tube 115 which extends axially along the outside of compressor housing 12 and, referring to FIGS. 3 and 4, extends into discharge chambers 32 and 36 to the extent that its open ends 116 are disposed above the normal height of a pool of liquid lubricant having surface level 118. Cross-over tube 115, as initially shown in FIG. 1 and various Figures thereafter, is an uninterrupted conduit, however, a sweat fitting or other like sealing fitting may disrupt the continuity to ease in the assembly process of the compressor assembly. Discharge pressure gas from front discharge chamber 32 is provided through cross-over tube 115 to discharge chamber 36, wherein it joins the discharge pressure gas exhausted from rear compressor assembly 26 and is discharged from compressor assembly 10 through discharge conduit or tube 120, which extends into the upper portion of rear discharge chamber 36. Each pool of liquid lubricant having level 118 is maintained at approximately equal heights in both discharge chambers 32 and 36 by excess lubricant being redistributed between the two discharge chamber sumps via cross-over tube 115 as level 118 rises above the height of tube end opening 116 (FIG. 3).

Figure 2:
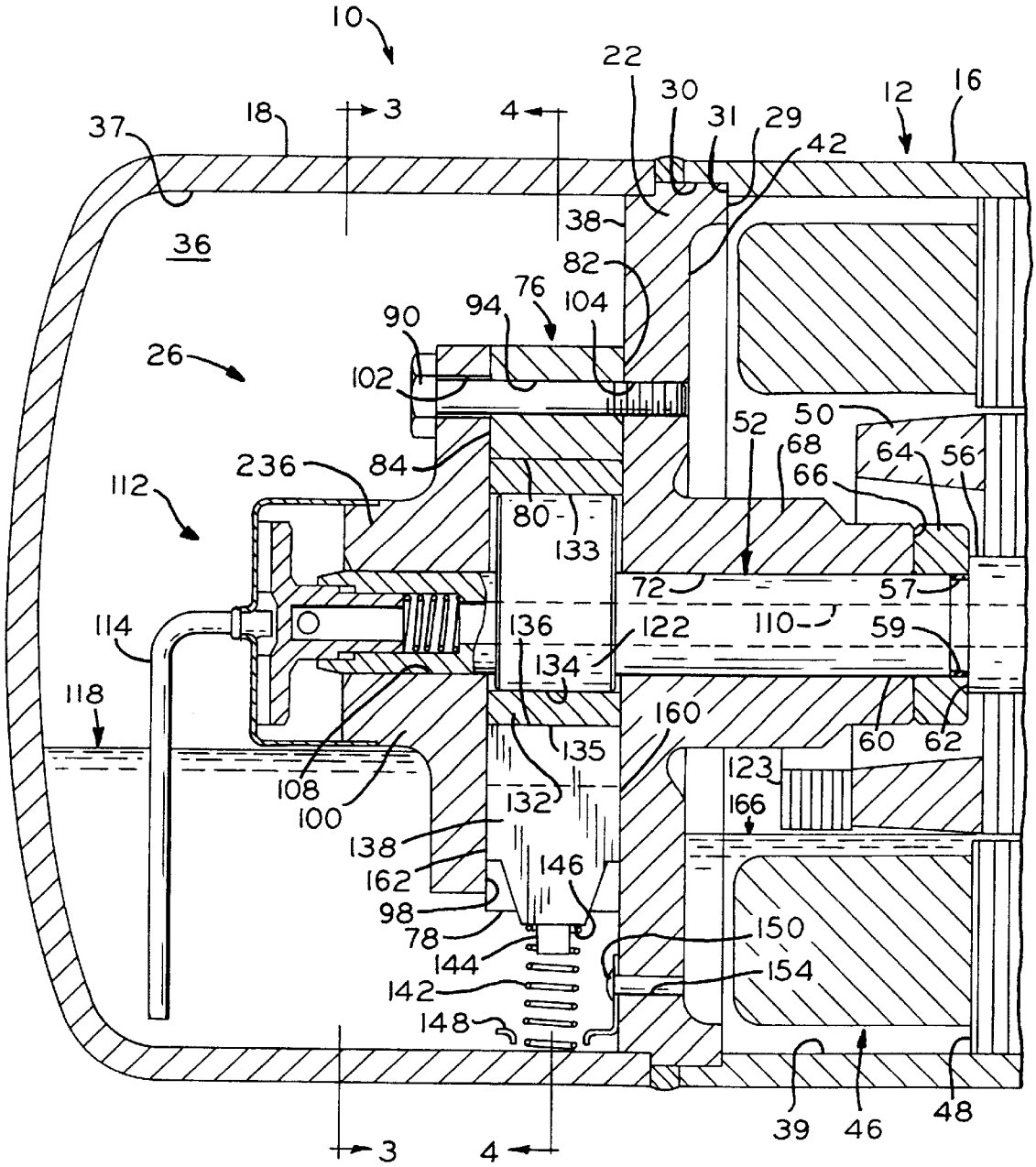
FIG. 2 is an enlarged fragmentary sectional side view of the rear portion of the compressor assembly shown in FIG. 1.

Referring again to FIG. 1, it can be seen that each compressor mechanism 24 and 26 is provided with eccentric 122 mounted on respective small diameter shaft portion 58, 60 and disposed in cavity 80 of each cylinder block 76. Each eccentric 122 is mounted about the axis of shaft 52 180° apart from the other to ensure proper balance. Further, counterweight 123 may be provided at opposite axial ends of rotor 50, 180° apart, to aid in balancing compressor assembly 10. Referring now to FIG. 4, which illustrates rear compressor mechanism 26 but which may be analogously applied to understand the structure of front compressor mechanism 24, it can be seen that eccentric 122 is disposed about shaft portion 60 and is fixed for rotation therewith by means of set screw 124 threadedly engaged in hole 126 provided in the eccentric. Terminal point 128 of set screw 124 is received in countersink 130 provided in the surface of shaft portion 60. With reference to FIGS. 2 and 4, it is shown that cylindrical roller piston 132 is provided about eccentric 122, inside surface 133 of roller piston 132 in sliding contact with outer peripheral surface 134 of eccentric 122. Further, it can be seen from FIGS. 1 and 2 that the forwardly and rearwardly facing axial surfaces of roller piston 132 are closely adjacent to the axial surfaces of the main and outboard bearings, with a maximum axial clearance preferably of about 0.0007 inch between the piston/bearing interfaces. In the known manner of operation of rotary compressors, roller piston 132 rotates on the cylindrical surface of cavity 80 in an epicyclic manner. Outer cylindrical surface 135 of roller piston 132 is in sliding contact with tip 136 of vane 138. Vane 138 is provided in each compressor mechanism 24, 26, and is urged into sliding engagement with roller piston surfaces 135 by means of springs 142 which encircle depending vane posts 144 and abuts vane surfaces 146 adjacent thereto. The opposite ends of springs 142 are retained by brackets 148 which are attached to surfaces 34 and 38 of main bearings 20 and 22 by means of rivets 150 provided in holes 152 and 154.

Referring to FIGS. 2 and 4, it can be seen that vane 138 has opposite, parallel planar sides 156 and 158, and opposite, parallel edges 160 and 162. Edges 160, 162 are in sliding engagement with the respective adjacent axial main and outboard bearing surfaces.

Suction gases enter compressor assembly 10 through suction conduit or tube 164 (FIGS. 1, 3), which extends into suction chamber 44. The outlet of suction tube 164 is covered by filter 165 in which debris carried by refrigerant returning to the compressor assembly may be captured. Filter 165 may be a wire cloth or finely meshed screen which may be spot welded over or press-fitted into the end of tube 164. Filter 165 may be 100 mesh wire screen, comprising 100 interwoven wires of 0.007 inch diameter per inch, which would only allow particles smaller than approximately 0.003 inch to pass through to chamber 44. Because the suction gases returning the compressor assembly are directed through suction tube 164 into chamber 44, which provides a relatively large expansion volume, a refrigerant system incorporating the inventive compressor would not ordinarily require an in-line suction muffler external to the compressor assembly.

Figure 10:
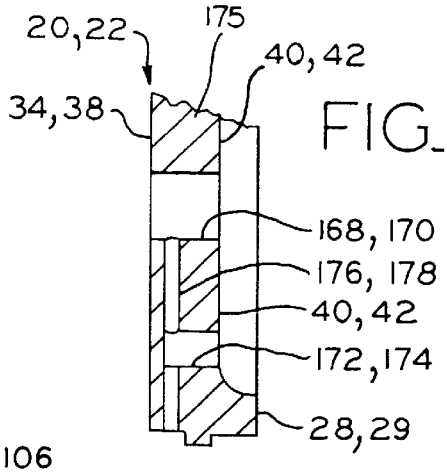
FIG. 10 is a fragmentary sectional side view of each of the main bearings shown in FIGS. 6 and 8, along lines 10—10 thereof.

Suction chamber 44 will contain a quantity of lubricant carried with refrigerant returning to compressor 10, and as shown in FIGS. 1 and 2, lubricant level 166 is substantially lower than lubricant levels 118 in discharge chambers 32 and 36. Referring to FIGS. 5–8, and 10, it can be seen that front and rear main bearings 20, 22 are provided with suction ports 168, 170, respectively, which extend axially therethrough (FIG. 10). Normally, suction chamber lubricant level 166 is below suction ports 168, 170 but may be above lubricant inlet bores 172, 174, provided in respective main bearing surfaces 40, 42. Bores 172, 174 extend axially from respective surfaces 40, 42 into web portion 175 of the main bearings, in which they terminate without projecting through to axial surfaces 34, 38 thereof. Referring to FIG. 10, radial conduits 176, 178 are provided in the peripheral edges of main bearings 20, 22 to fluidly connect lubricant intake bores 172, 174 with suction ports 168, 170. The peripheral openings of conduits 176, 178 are sealed upon assembly and welding of housing portions 14, 18 to main bearings 20, 22.

Figure 11:
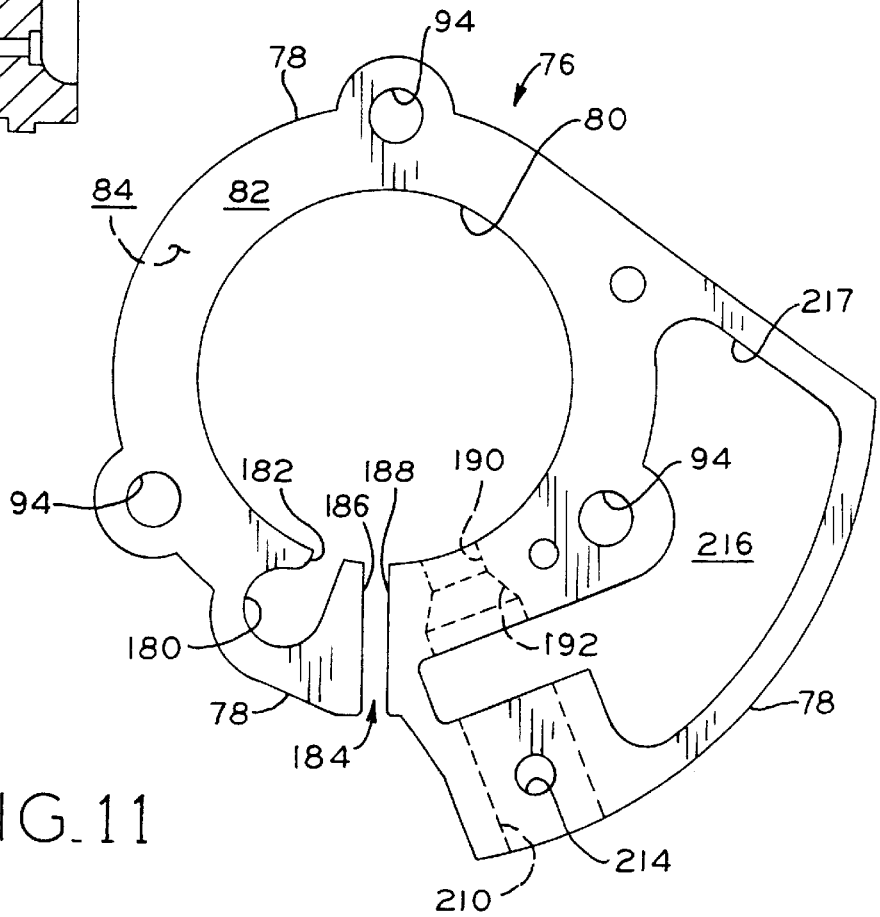
FIG. 11 is a front view of the common front and rear cylinder block of the compressor assembly shown in FIG. 1.
Figure 14:
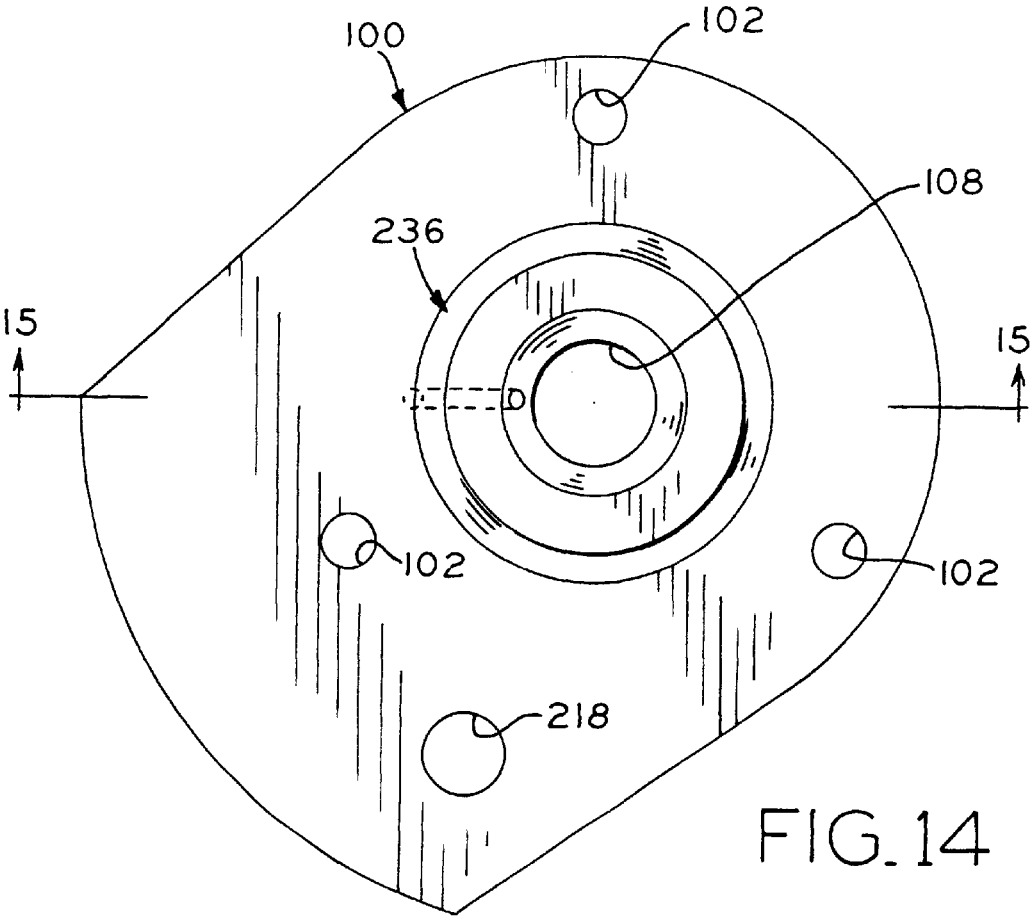
FIG. 14 is a rear view of the rear outboard bearing of the compressor assembly shown in FIG. 1.

Suction ports 168, 170 communicate with suction port 180 in cylinder block 76 which can be seen in FIGS. 4 and 11. Like cylindrical cavity 80, suction port 180 extends axially between the surfaces 82 and 84 of cylinder block 76, and communicates directly with cavity 80 through suction inlet 182. As suction gas flows from suction chamber 44 into suction port 180 through ports 168, 170, it may aspirate oil from chamber 44 through lubricant intake apertures 172, 174 and bores 176, 178 into suction port 180, if level 166 is above the height of apertures 172, 174, thus scavenging oil from the suction chamber. This scavenged oil is carried by the refrigerant into cavity 80, which comprises the compression chamber of compressor mechanisms 24, 26, and delivered therethrough to discharge chambers 32, 36.

In cylinder block 76, adjacent suction inlet 182 is a vertically oriented channel or vane slot 184 which extends the width of the cylinder block between surface 82 and surface 84 and has generally parallel side walls 186, 188 (FIG. 11). Vane 138 is disposed in vane slot 184 and vertically reciprocates therein as its tip 136 follows outside surface 135 of roller piston 132, with one of vane surfaces 156, 158 adjacent vane slot sidewall 186, the opposite vane surface adjacent vane slot sidewall 188. Vane 138 may be a sintered powder metal part, the tolerances between its opposite planar surfaces 156, 158 and its opposite edges 160, 162 closely controlled. Cylinder block 76 may be manufactured from individually cast blanks which have been machined or they may be sintered powder metal parts. Alternatively, an axially elongate "loaf" of uniform cross section may be produced by casting, powder metal techniques or extrusion, which is then sawed into individual cylinder blocks of appropriate thickness and machined.

An "off the shelf" cylinder block, including an inwardly tapered vane slot (FIG. 50), has a vane slot width less than the vane and requires a force being exerted, proximate to the vane slot walls, to force them apart to receive the vane. In order to provide proper clearances between vane slot sidewalls 186*a* and 188*a* and the adjacent vane surfaces 156, 158, a process of assembling a rotary compressor according to the present invention includes the steps of: forcing apart vane slot walls 186*a* and 188*a* slightly; providing a dummy vane or gauge vane (FIGS. 51 and 54) having generally the same shape as vane 138 except being about 0.0020 inch thicker between its opposite planar surfaces in vane slot 184*a;* allowing vane slot walls 186*a,* 188*a* to resiliently come into contact with the planar sides of the gauge vane; assembling the main bearing, cylinder block and outboard bearing together about the shaft/eccentric/piston assembly; placing and torquing bolts 90 to appropriate levels to compress cylinder block 76*a* between the bearings, thereby establishing sufficient frictional contact between the abutting axial surfaces of the bearings and the cylinder block to hold vane slot walls l86*a,* 188*a* at their current spacing; and removing the gauge vane and substituting therefor vane 138, which will have approximately 0.0020 inch clearance between one of its planar sides 156, 158 and its adjacent vane slot sidewall.

An alternative to the inwardly tapered vane slotted cylinder block, as hereinabove described, is an "off the shelf" cylinder block including an outwardly tapered vane slot (FIG. 53), having a vane slot width greater than the vane and requiring a force being exerted, proximate to the vane slot walls, to force them together to support the vane. A method of decreasing the width of vane slot 184*b* to provide a suitable clearance between the vane 138 and vane slot 184*b* may be employed. In order to provide proper clearances between vane slot sidewalls 186*b* and 188*b* and the adjacent vane surfaces 156, 158, a process of assembling a rotary compressor according to the present invention includes the steps of: providing the gauge vane having generally the same shape as vane 138 except being about 0.0020 inch thicker between its opposite planar surfaces in vane slot 184*b;* decreasing the width of the vane slot 184*b* by forcing the vane slot walls 186*b* and 188*b* slightly together to frictionally hold the gauge vane therebetween; applying an inward force to the vane slot walls l86*b,* 188*b* to come into contact with the planar sides of the gauge vane; assembling the main bearing, cylinder block and outboard bearing together about the shaft/eccentric/piston assembly; placing and torquing bolts 90 to appropriate levels to compress cylinder block 76*b* between the bearings, thereby establishing sufficient frictional contact between the abutting axial surfaces of the bearings and the cylinder block to hold vane slot walls l86*b,* 188*b* at their current spacing; and removing the gauge vane and substituting therefor vane 138, which will have approximately 0.0020 inch clearance between one of its planar sides 156, 158 and its adjacent vane slot sidewall.

Figure 50:
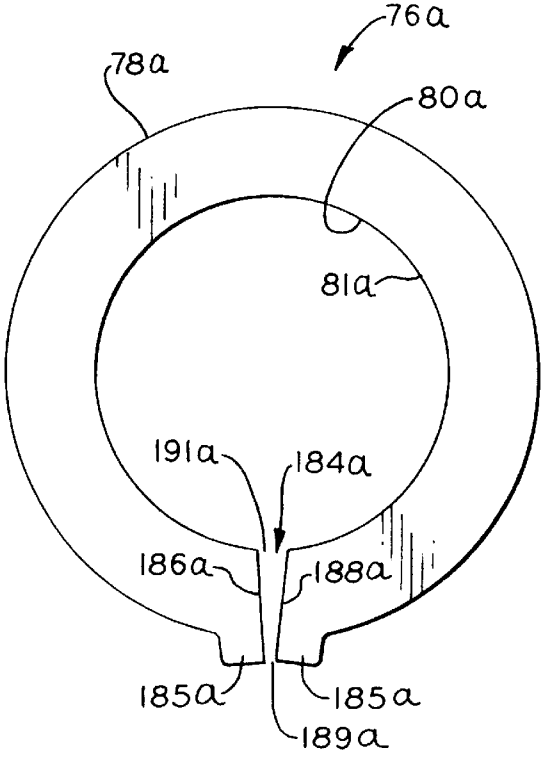
FIG. 50 is a simplified model of the common cylinder blocks of the compressor assemblies shown in FIGS. 1, 18, 24 and 46–47, showing an inwardly tapered vane slot.

Referring now to FIGS. 50–55, model cylinder blocks are disclosed, functionally appertaining to all the cylinder blocks disclosed herein, however, simplified to aid in the explanation of the relationship between the vane slot and the cylinder block of the present invention compressor assembly. Referring now to FIG. 50, shown is a model cylinder block 76*a* having a cylindrical cavity 80*a* defined by a cylinder wall 81*a.* Also shown is tapered vane slot 184*a* cut all the way through the cylinder wall 81*a* and extending to an outer periphery 78*a* of the model cylinder block 76*a*. The taper in tapered slot 184*a* has been exaggerated for clarity. Vane slot 184*a* is defined by a pair of vane slot sidewalls 186*a* and 188*a,* respectively, and further includes a first vane slot opening 189*a,* proximate to the outer periphery 78*a* of the model cylinder block 76*a,* and a second vane slot opening 191*a,* which is proximate to the cylinder wall 81*a* within the cylindrical cavity 80*a.* FIG. 50 shows tapered vane slot 184*a* having the first vane slot opening 189*a,* which is relatively narrower than the second vane slot opening 191*a,* for reasons further described below.

Figure 51:
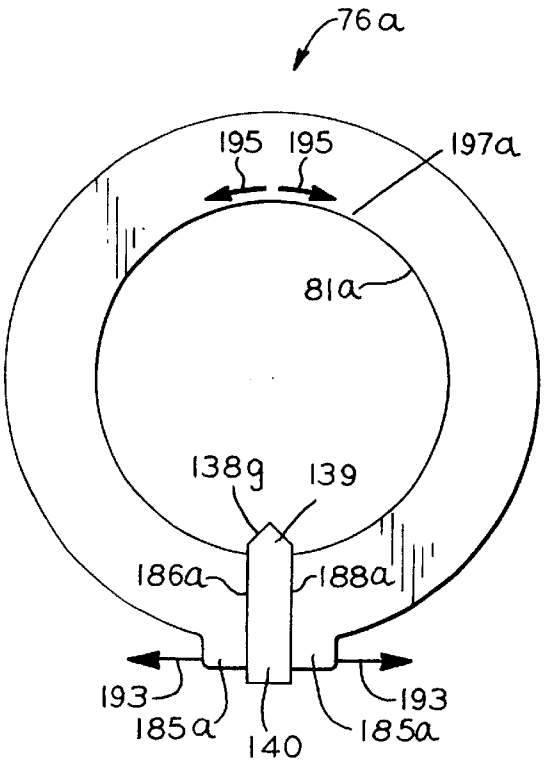
FIG. 51 is the model cylinder block of FIG. 51, showing a gauge vane therein, outward forces applied thereto and a state of circumferentially oriented tensile stress.

FIG. 51 discloses the insertion of a gauge vane showing the model cylinder block 76*a* of FIG. 50, having a pair of equal and opposing forces 193 imparted on extended portions 185*a* of the cylinder block to elastically spread apart the vane slot sidewalls 186*a* and 188*a,* respectively. A gauge vane 138*g* has been inserted between the vane slot sidewalls 186*a,* 188*a* and is shown holding the vane slot sidewalls 186*a,* 188*a* apart, and substantially parallel. The gauge vane 138*g* has first and second ends 139 and 140, respectively, wherein the first end 139 of gauge vane 138*g* has a tapered contour so that the gauge vane may be forcefully wedged into the first vane slot opening 189, which acts similar to forces 193 spreading apart the vane slot sidewalls 186*a,* 188*a,* to fit the vane therebetween. With the gauge vane 138*g* in place and having vane slot sidewalls 186*a* and 188*a,* respectively, in contact with the gauge vane 138*g,* a state of stress develops in cylinder block portions 197*a* and is represented by arrows 195. The state of stress 195 is circumferentially oriented about the cylinder block 76*a* and is disposed within cylinder block portions 197*a,* which are located immediately adjacent cylinder wall 81*a,* and continue circumferentially about the cylinder block 76*a.* The state of stress 195 is tensile in nature and circumferentially orients therealong a substantial portion of cylinder block portions 197*a*. State of stress 195 is caused by the spreading apart of vane slot sidewalls 186*a* and 188*a,* respectively, and once created, the cylinder block 76*a* is secured by bolting or the like to an adjoining bearing or bearings, to preserve the stresses within cylinder block portions 197*a*. Thus, once the gauge vane 138*g* is removed the state of stress 195 remains preserved therein, as hereinafter described.

Figure 52:
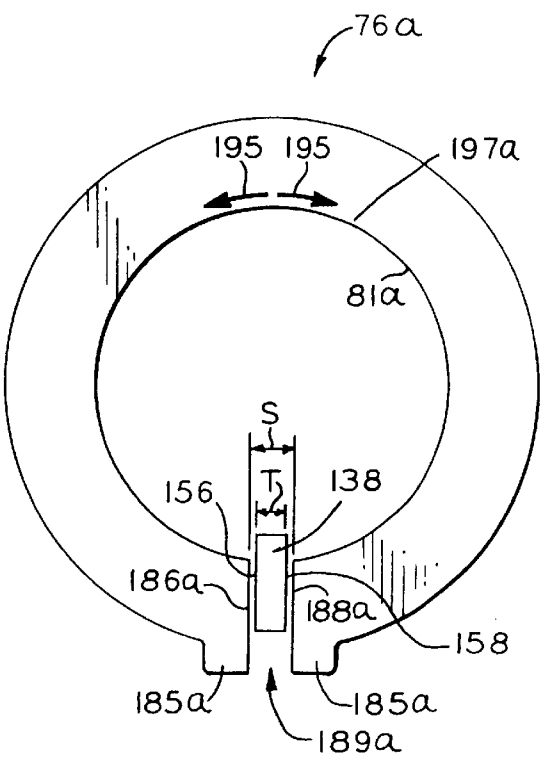
FIG. 52 is the model cylinder block of FIG. 51, showing an operable vane slot of width "S" and the state of circumferentially oriented tensile stress preserved therein.

Referring to FIG. 52, the model cylinder block 76*a* is shown having preserved the circumferentially oriented stress, as shown by arrows 195, however, the gauge vane 138*g* has been removed and replaced by vane 138. FIG. 52 shows, albeit exaggeratedly, a vane slot width "S" being preserved, with gauge vane 138*g* removed, and the state of circumferentially oriented stress 195 remaining preserved therein. The vane 138, having a width or thickness "T", is freely reciprocatable within vane slot width "S", the width between "S" and "T" defines a clearance. In order for vane 138 to reciprocate within vane slot width "S" the clearance must be suitable, however, an excessive clearance leads to premature vane wear, and additionally, inefficient compressor mechanism operation due to refrigerant gas blow-by through the clearance.

Figure 55:
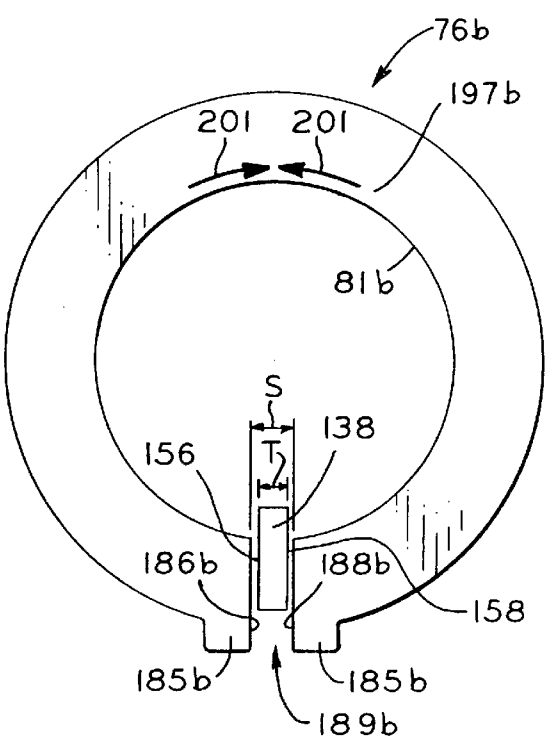
FIG. 55 is the model cylinder block of FIG. 53, showing an operable vane slot of width "S" and the state of circumferentially oriented compressive stress preserved therein.
Figure 54:
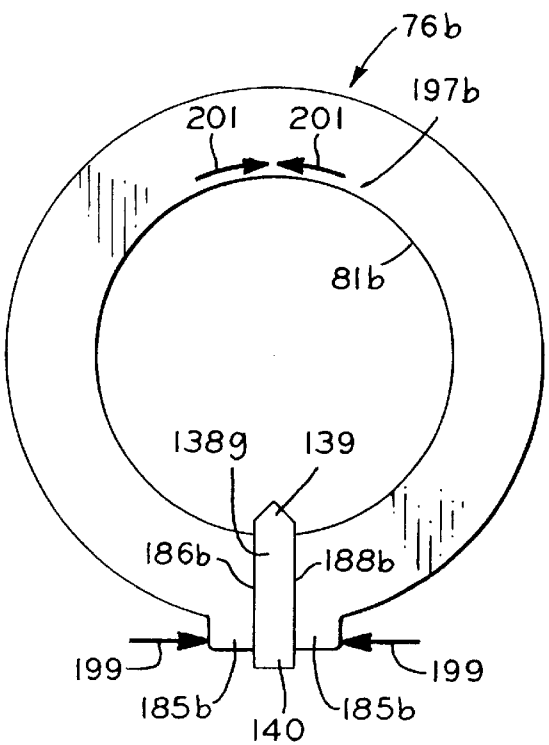
FIG. 54 is the model cylinder block of FIG. 53, showing a gauge vane therein, inward forces applied thereto and a state of circumferentially oriented compressive stress.
Figure 53:
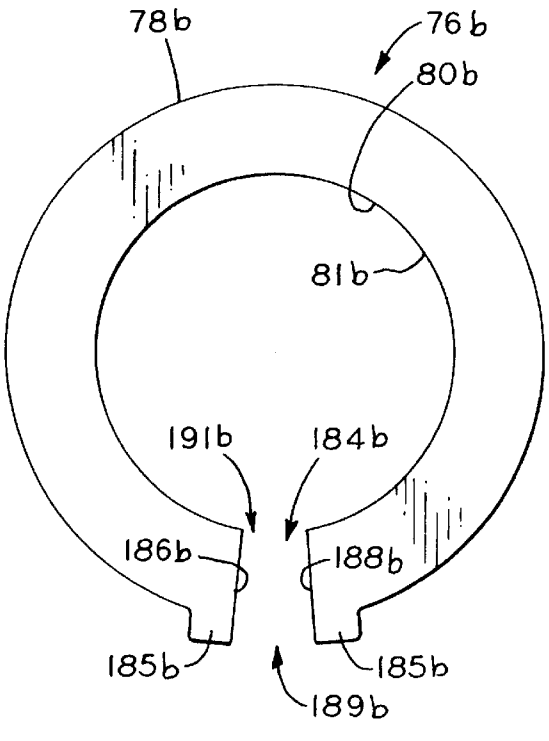
FIG. 53 is a simplified model of the common cylinder blocks of the compressor assemblies shown in FIGS. 1, 18, 24 and 46–47, and an alternative to the model cylinder block of FIG. 51, showing an outwardly tapered vane slot.

Referring now to FIGS. 53–55, similar to FIGS. 50–52, a simplified cylinder block is shown, however the cylinder block has a closeable vane slot. Referring now to FIG. 53, shown is a model cylinder block 76*b* having a cylindrical cavity 80*b* defined by a cylinder wall 81*b*. Tapered vane slot 184*b* is cut all the way through the cylinder wall 81*b* and extends to an outer periphery 78*b* of the model cylinder block 76*b*. The taper in tapered slot 184*b* has been exaggerated for clarity. Vane slot 184*b* is defined by a pair of vane slot sidewalls 186*b* and 188*b*, respectively and further includes a first vane slot opening 189*b*, proximate to the outer periphery 78*b* of the model cylinder block 76*b*, and a second vane slot opening 191*b*, which is proximate to the cylinder wall 81*b* within the cylindrical cavity 80*b*. FIG. 53 shows tapered vane slot 184*b*, having the first vane slot opening 189*b*, which is relatively broader than the second vane slot opening 191*b*, for reasons further described below.

FIG. 54 represents the gauge vane insertion or vane slot setting step of the inventive method, showing the model cylinder block 76*b* of FIG. 53, having a pair of equal and opposing forces 199 imparted on extended portions 185*b* of the cylinder block 76*b* elastically closing together the vane slot sidewalls 186*b* and 188*b*, respectively. A gauge vane 138*g* has been inserted between the vane slot sidewalls 186*b*, 188*b* and is shown contacting vane slot sidewalls 186*b*, 188*b* to provide a substantially parallel slot. Gauge vane 138*g* used on cylinder block 76*a*, may also be utilized on cylinder block 76*b* in providing a standard in which to set the vane slot. With the gauge vane 138*g* in place and having vane slot sidewalls 186*b* and 188*b*, respectively, in contact with the gauge vane 138*g*, a circumferentially oriented state of stress 201 develops in cylinder block portions 197*b*, which are located immediately adjacent cylinder wall 81*b*. The cylinder block portions 197*b* are circumferentially continuous about the cylinder wall 81*b*. The circumferentially oriented state of stress 201 is compressive in nature, for a substantial portion of cylinder block portions 197*b* about the cylinder wall 81*b*. State of stress 201 is caused by the closing together of vane slot sidewalls 186*b* and 188*b*, respectively, and once the stress 201 is created, the cylinder block 76*b* is thereafter secured by bolting or the like to an adjoining bearing or bearings, to preserve the stresses within the cylinder block portions 197*b*. Thus, subsequent to the gauge vane 138*g* being removed the state of stress 201 is preserved therein, as hereinafter described.

Referring to FIG. 55, the model cylinder block 76*b* is shown having the gauge vane 138*g* removed and the gauge vane width "S" preserved. Also preserved is the circumferentially oriented compression stress 201. FIG. 55 shows the vane 138 in the vane slot 184*b*. The vane 138 having a width or thickness "T" is freely reciprocatable within vane slot width "S" and the width between "S" and "T" defines a clearance. In order for vane 138 to reciprocate within vane slot width "S" the clearance must be suitable, however, an excessive clearance leads to excessive vane wear and malfunction. Also an excessive clearance coincides with inefficient compressor operation due to refrigerant gas blow-by through the clearance.

As mentioned above, during the step of increasing the width "S" of the vane slot 184*a*, cylinder block portions 197*a* develop a state of circumferentially oriented tensile stress 195, which is preserved once the cylinder block 76*a* is clamped between outboard bearings 88, 100 and main bearings 20, 22. In contrast, during the step of decreasing the width "S" of the vane slot 184*b*, cylinder block portions 197*b* develop a state of circumferentially oriented compressive stress 201, which is preserved once the cylinder block is clamped between outboard bearings 88, 100 and main bearings 20, 22. Generally, pre-stressing portions of the cylinder block 76, as hereinabove explained, results in offsetting dynamic forces imparted on the cylinder block 76 by the rotating roller piston 132, to enhance wear resistence and longevity of the cylinder block 76. Furthermore, the tapered vane slotted cylinder block requires fewer machining operations and costly machining operations may be avoided.

Referring now to FIGS. 1, 2 and 4, and more specifically the liquid lubrication of the vane and vane slot, each liquid lubricant pool having surface level 118 in discharge chambers 32, 36 is of sufficient height to immerse vane 138 in the pool of lubricant. Immersion of vane 138 in the lubricant seals the clearance between vane 138, the sidewalls of vane slot 184 and the adjacent axial bearing surfaces against refrigerant blow-by from the compression chamber, as well as lubricates the vane surfaces.

Referring again to FIG. 4, it can be seen that cylindrical discharge opening 190 is provided in the cylindrical wall of cavity 80 adjacent vane slot 184 on the opposite side thereof from inlet opening 182. By providing cylindrical discharge opening 190 in the wall of cavity 80 adjacent vane slot 184, rather than in the axial surface of the outboard bearing, an outlet port of unchanging area is provided for discharge gases to be exhausted from the compression chamber throughout the compression cycle, regardless of the roller piston position. Adjacent and downstream of cylindrical discharge opening 190 is frustoconical valve seat 192 on which the mating frustoconical surface of head 194 of poppet 196 seals. Poppet head 194 is urged into sealing contact with surface 192 by compression spring 198 disposed about poppet shaft 200. One end of spring 198 abuts the underside of poppet head 194; its opposite end abuts disc 202, which is cushioned by neoprene cushion 204 and disposed in pocket 206 of poppet retainer 208. Retainer 208 limits the radial travel of poppet 196 away from seat 192 to about ⅛ inch, the terminal end of poppet shaft 200 opposite head 194 abutting disc 202 at the furthest extent of poppet travel. Neoprene cushion 204 softens the impact of the poppet shaft end against disc 202, thereby quieting the operation of the compressor. Poppet 196 prevents previously exhausted discharge pressure gases from reentering the compression chamber, where they would otherwise be recompressed, undermining the efficiency of the compressor. Poppet 196 is preferably made of a durable yet lightweight material, for example a plastic such as Vespel™, as may retainer 208. Disc 202 may be plastic or metal.

Retainer 208 is provided in radially extending cylinder block bore 210 and maintained in position therein by means of pin 212 extending through a pair of holes 214 provided on opposite axial sides of bore 210. Pin 212 is prevented from moving axially within holes 214 by its ends abutting the adjacent axial surfaces of the main and outboard bearings. Discharge gases compressed in the compression chamber urge poppet 196 off its seat 192 against the force of spring 198 and flow past poppet head 194 into discharge cavity 216 provided in cylinder block 76. Poppet 196 is urged by spring 198 back into sealing engagement with seat 192 once the discharge pressure gas has exited the compression chamber through opening 190, preventing the expelled gas from flowing back into the compression chamber.

Discharge cavity 216 extends axially between cylinder block surfaces 82, 84, and is defined by cavity surface 217 and the adjacent axial surfaces of the main and outboard bearings. Cavity 216 serves to attenuate gas-borne noises and pressure pulses arising from operation of the compressor. As shown in FIG. 4, discharge gases exit cavity 216 by means of discharge port 218 provided in outboard bearing 100 (and through corresponding port 220 in front outboard bearing 88, FIG. 12). Discharge gases expelled from cylinder block discharge cavity 216 through discharge ports 218, 220 enter respective discharge chambers 32 and 36. Those of ordinary skill in the art will appreciate that discharge chambers 32 and 36 serve as mufflers as well, attenuating gas-borne noises and pressure pulses before discharge pressure refrigerant exits compressor assembly 10 through discharge conduit or tube 118. Furthermore, each compressor mechanism 24, 26, respectively, draws refrigerant gases from the suction chamber 44 and discharges the compressed gases into the discharge chambers 32, 36 respectively, to further attenuate sources of fluid borne noise and vibration which would be otherwise carried by suction conduits, discharge conduits and the like, rigidly connecting the housing to the compressor mechanisms.

Figure 15:
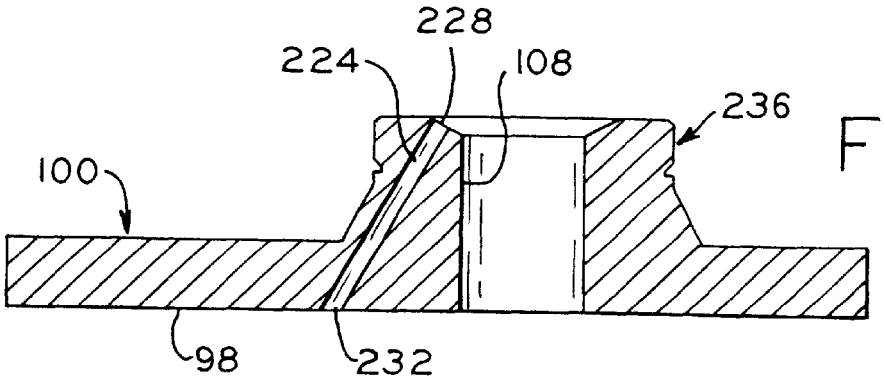
FIG. 15 is a sectional side view of the outboard bearing of FIG. 14, along line 15—15 thereof.

As shown in FIGS. 13 and 15, outboard bearings 88 and 100 are provided with conduits 222 and 224 which respectively extend from inlets 226, 228 to outlets 230, 232. Inlets 226 and 228 are provided proximate the terminal ends of shaft 52 in respective bearing hub portions 234, 236; outlets 230, 232 open onto respective axial surfaces 86, 98 into regions of the compression chambers which are at a pressure intermediate suction and discharge pressure (FIG. 4). The outboard axial surfaces of roller pistons 132 cover and block outlets 230, 232 as the roller pistons reach orientations about the cylindrical surfaces of cavities 80 normally corresponding to pressures at and above which oil, which is approximately at discharge pressure, may be forced to reversibly flow backwards through conduits 222, 224. Referring to FIG. 1, it can be seen that front outboard bearing hub portion 234 is provided with oil diverter cap 238, which may be made of sheet metal. Cap 238 directs oil received from shaft bore 110 and directs it towards inlet 226 of conduit 222. Through conduit 222 oil is provided to the compression chamber of the front compressor mechanism, lubricating exposed surfaces therein. Similarly, hub 236 of rear outboard bearing 100 is provided with cap 240 enclosing a portion of pump 112 and which may also be made of sheet metal. Cap 240 is provided with an central aperture through which lubricant draw conduit or tube 114 is fitted. Cap 240 directs lubricant received from lubricant tube 114 upstream of pump 112 through inlet 228 of conduit 224.

Figure 16A:
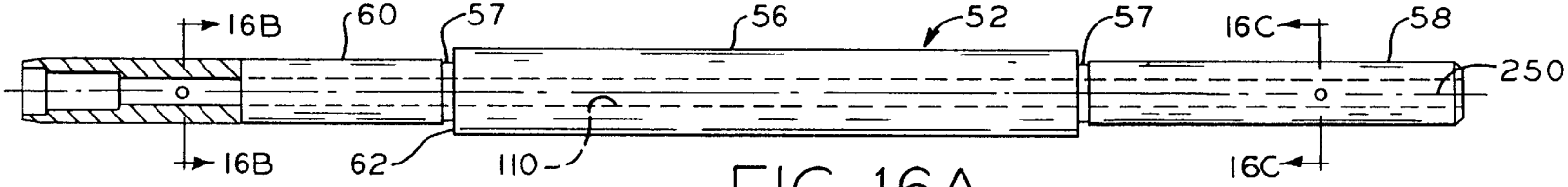
FIG. 16A is a partial sectional side view of the shaft of the compressor assembly shown in FIG. 1.
Figure 16C:
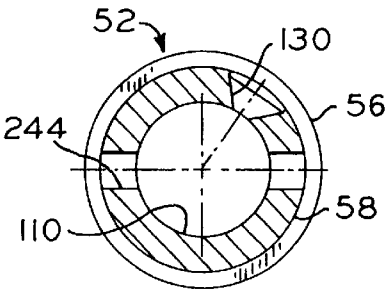
FIG. 16C is an enlarged sectional front view of the shaft shown in FIG. 16A, along line 16C–16C thereof.
Figure 16B:
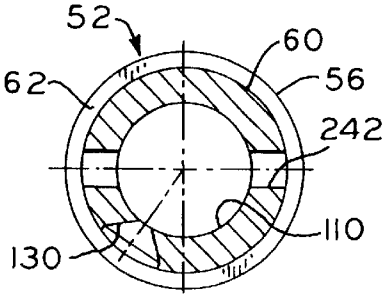
FIG. 16B is an enlarged sectional rear view of the shaft shown in FIG. 16A, along line 16B–16B thereof.
Figure 17B:
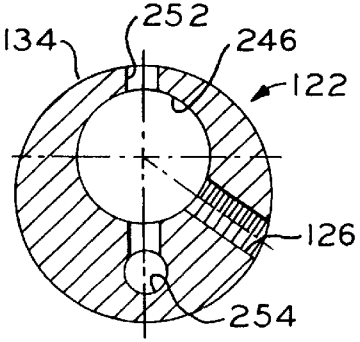
FIG. 17B is a sectional end view of the eccentric shown in FIG. 17A, along line 17B—17B thereof.
Figure 17A:
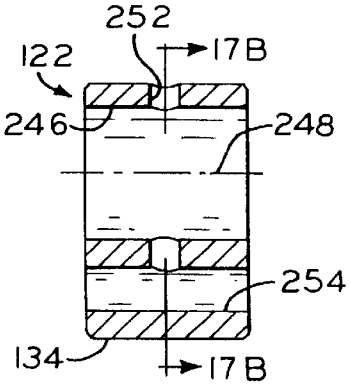
FIG. 17A is an enlarged sectional side view of an eccentric of the compressor assembly shown in FIG. 1.

FIGS. 16A through 16C detail the shaft 52. As seen in FIGS. 16B and 16C, at the point of respective small diameter shaft portions 60 and 58 about which eccentrics 122 are attached thereto. FIG. 16B shows that shaft portion 60 is provided with crossbore 242 which extends through the diameter of shaft portion 60 intersecting axial bore 110. FIG. 16C shows that shaft portion 58 is provided with similar crossbore 244. Referring now to FIGS. 17A and 17B, there is shown cross-sectional views of eccentric 122, which as discussed above is attached to the shaft 52 at countersinks 130 provided in shaft portions 58 and 60. Eccentric 122 is provided with axial bore 246 having centerline 248 offset and parallel to axis 250 of shaft 52 (FIG. 16A). Eccentric 122 is provided with crossbore 252 which extends through eccentric bore 246 to a second axial bore 254 extending between the axial surfaces of the eccentric. With eccentric 122 assembled to shaft portions 58, 60, eccentric crossbore 252 is brought into alignment with shaft crossbores 244 and 242. Because one end of crossbore 252 opens to outside surface 134 of the eccentric, oil provided through bore 110 to aligned bores 242, 252 and 244, 252 lubricates the interfacing cylindrical surfaces 133 and 134 between roller piston 132 and eccentric 122. The opposite end of crossbore 252 extends into axial eccentric bore 254, providing oil received from shaft bore 110 axially into the forward and rear spaces provided between the eccentric axial surfaces and the adjacent axial surfaces of the main and outboard bearings, these spaces inside surface 133 of roller piston 132; during normal compressor operation, these spaces are filled with oil.

Figure 18:
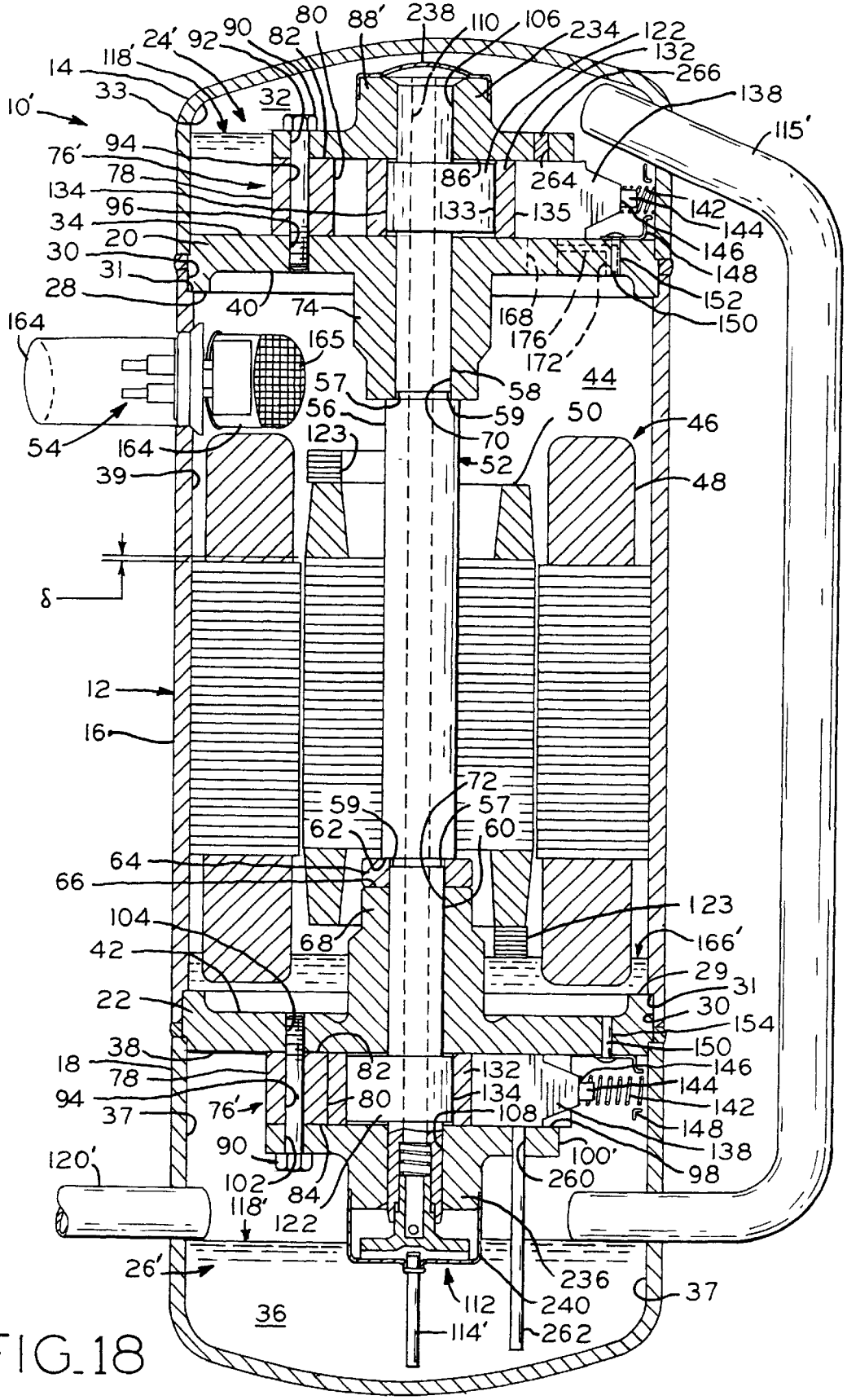
FIG. 18 is a sectional side view of a second embodiment of a compressor assembly according to the present invention, also showing the cross-over tube fluidly connecting the two discharge chambers and the compressor assembly discharge tube.

Referring now to FIG. 18, there is shown compressor assembly 10', a second embodiment according to the present invention. Compressor 10' is for the most part identical with compressor assembly 10, except is adapted to be vertically oriented. Thus with respect to the preceding discussion, the forward compressor mechanism 24 is, in this second embodiment, referred to as upper compressor mechanism 24'. Similarly, with respect to the preceding discussion, rear compressor mechanism 26 is now lower compressor mechanism 26', All previously discussed components of compressor assembly 10 are configured and carried over into compressor assembly 10' in the same way except as distinguished hereinbelow.

Figure 21:
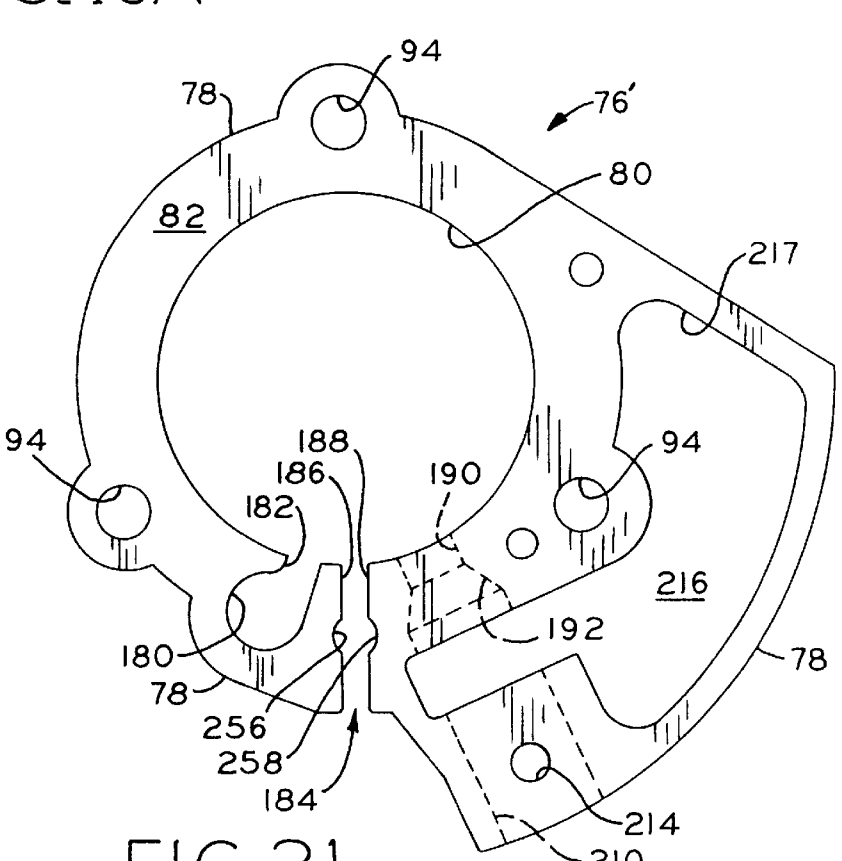
FIG. 21 is a top view of the common upper and lower cylinder block of the compressor assembly shown in FIG. 18.
Figure 19:
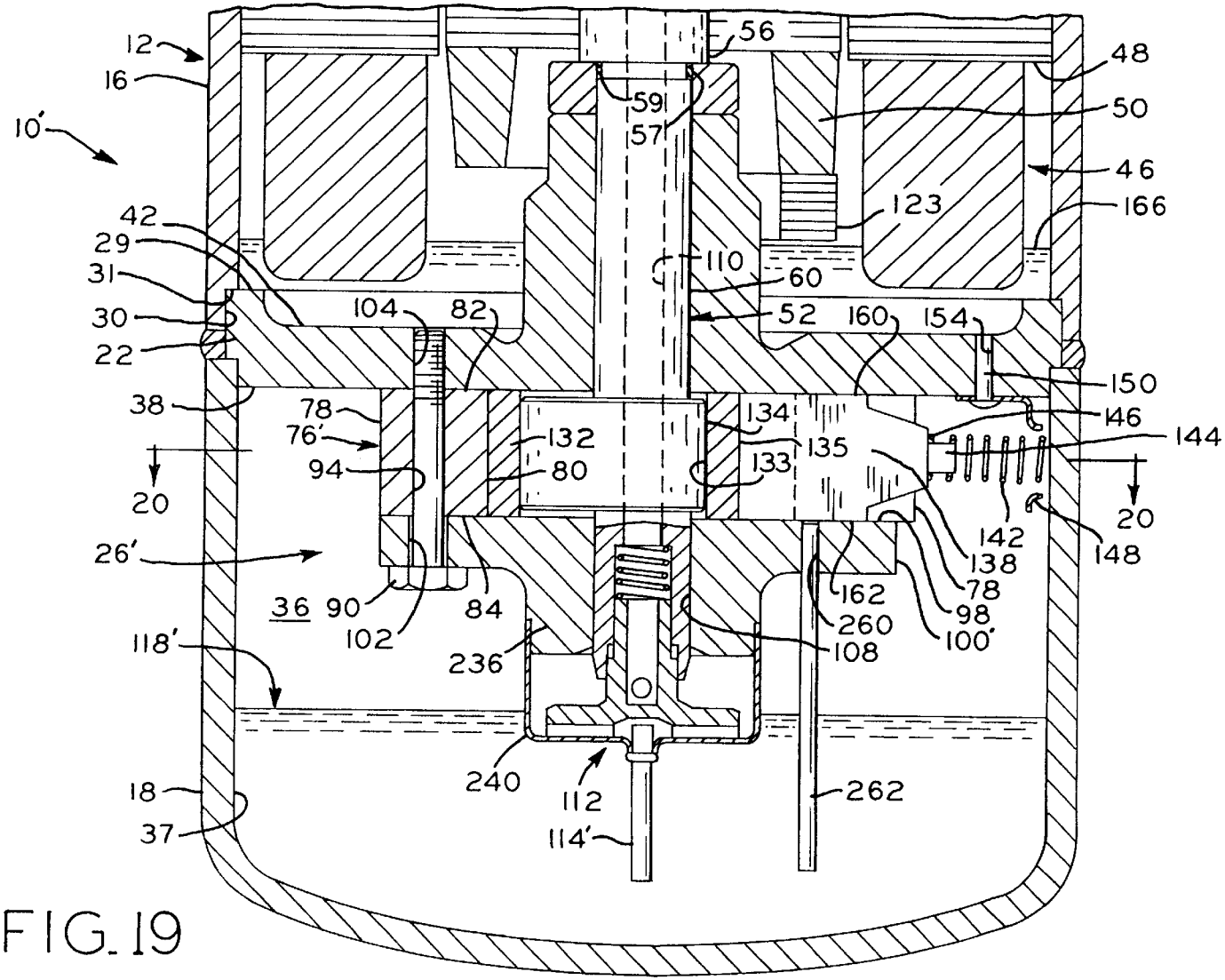
FIG. 19 is an enlarged fragmentary sectional side view of the bottom portion of the compressor assembly shown in FIG. 18.
Figure 20:
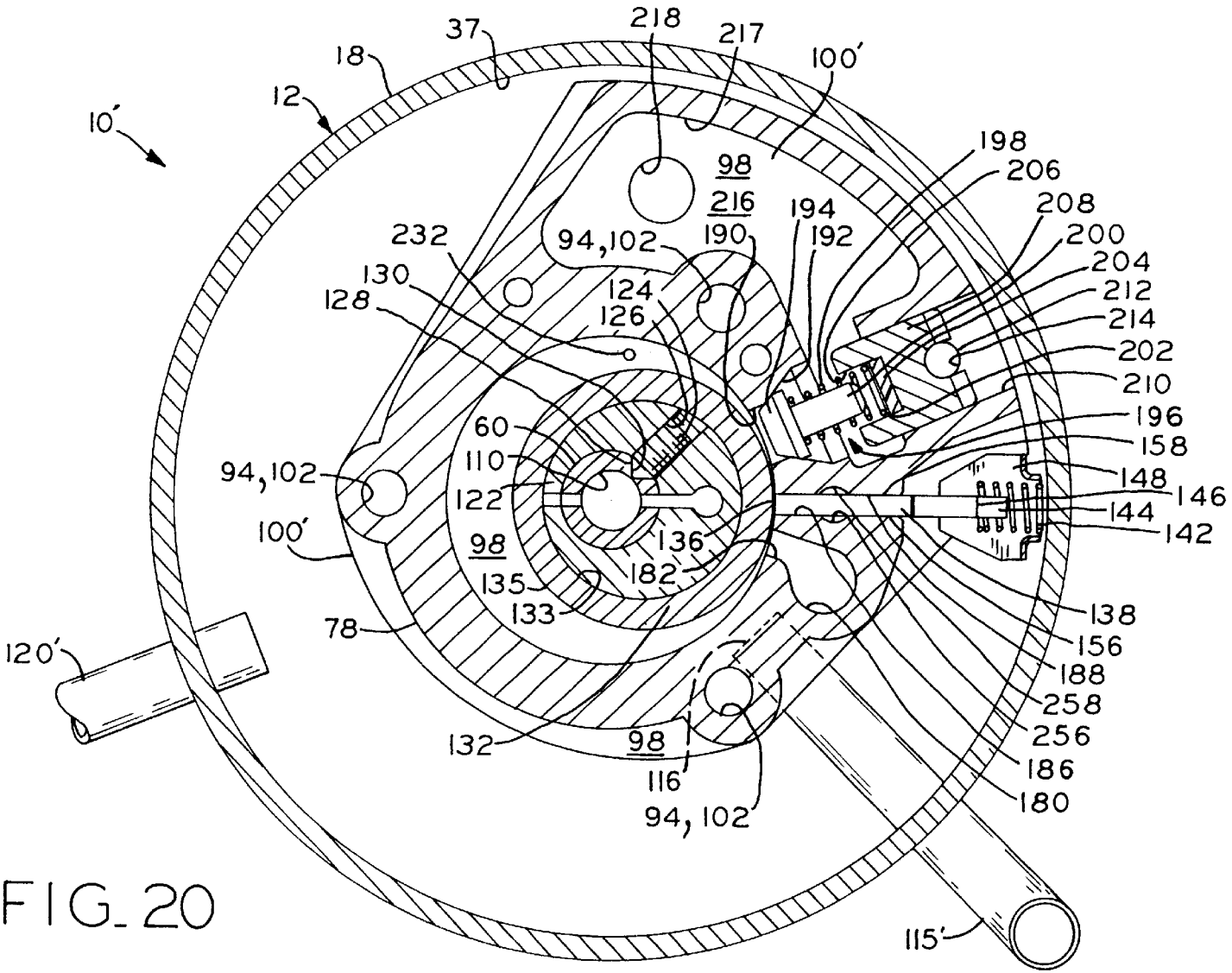
FIG. 20 is a sectional plan view of the compressor assembly shown in FIG. 19, taken along line 20—20 thereof.
Figure 22:
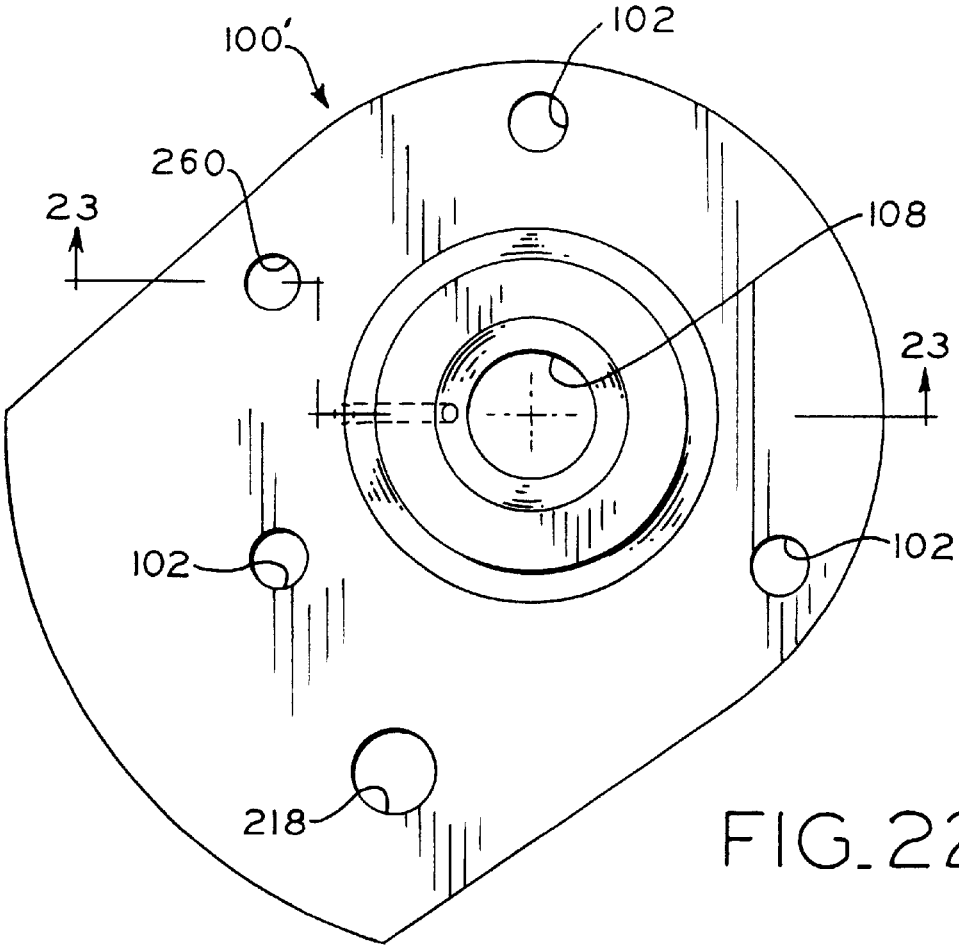
FIG. 22 a bottom view of the lower outboard bearing of the compressor assembly shown in FIG. 18.
Figure 23:
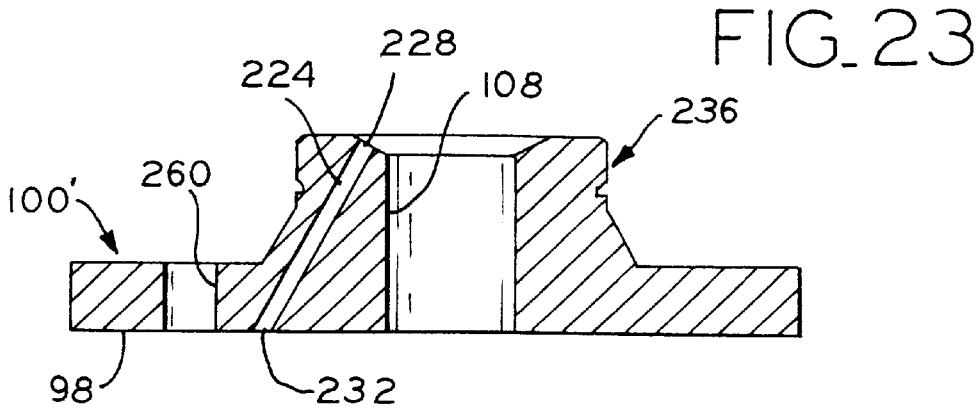
FIG. 23 is a sectional side view of the outboard bearing of FIG. 22, along line 23—23 thereof.

Compressor assembly 10', being vertically oriented, has a pair of pools of liquid lubricant having levels 118' in each of its discharge chambers 32, 36. The level of lubricant or oil 118' in upper discharge chamber 32 is, in normal operation of compressor assembly 10', above axial surface 86 of upper outboard bearing 88'. Thus vane 138 of upper compressor mechanism 24' is, as described with respect to front and rear compressor mechanisms 24, 26 of compressor assembly 10, immersed in oil. Oil may initially collect in the lower portion of suction chamber 44, as shown in FIG. 18 having level 166', however, the oil eventually aspirates through the suction port 170 (FIGS. 7 and 8), and commonly exhibits a negligible level therein. As described above, oil will be scavenged from chamber 44 through aperture 174 in lower main bearing 22. Aperture 172 of upper main bearing 20 will draw suction pressure gas into port 168 instead of oil. As best seen in FIG. 19, oil draw tube 114' extends downwardly from cap 240 to provide access to the oil in the lower portion of chamber 36. Compressor assembly 10' employs the same lubrication methods as described above, with the except that, because vane 138 of lower compressor mechanism 26' cannot be immersed in oil, additional lubrication providing means is provided. Referring to FIG. 21, there is shown cylinder block 76' which is identical to cylinder block 76 with the exception that sidewalls 186, 188 of vane slot 184 are provided with scallops 256, 258, respectively. These scallops have the shape of a circle segment and, as will be described further below, allow oil to be provided adjacent the planar sides of vane 138 in lower compressor mechanism 26. Referring to FIG. 22, it is seen that lower outboard bearing 100' is provided with an axially directed through bore 260 of size matching the circle which would be defined by scallops 256 and 258 in cylinder block 76'. Into bore 260 is press fitted second oil draw conduit or tube 262 which extends from the location approximate surface 98 of outboard bearing 100' downwardly into the oil contained in the lower portion of chamber 36. During operation of compressor assembly 10', as vane 138 reciprocates in compressor mechanism 26', the oil in chamber 36, which is under discharge pressure, is drawn through oil draw tube 262 into scallops 256, 258, sealing the gap between vane slot sidewalls 186, 188 and planar sides 156, 158 of the vane. Thus, it can be seen that oil forced or drawn upward through tube 262 lubricates and seals vane 138 in vane slot 184. Upper compressor mechanism 24' may utilize a common cylinder block 76'. Upper outboard bearing 88', may be provided with bore 264 corresponding to bore 262 in lower outboard bearing 100' to, perhaps, better facilitate machining operations. If upper outboard bearing 88' is provided in compressor assembly 10' instead of outboard bearing 88, bore 264 would be plugged to prevent the ingress of discharge pressure gasses from chamber 32 into scallops 256, 258. Bore 264 would be plugged with plug 266 (FIG. 18).

Figure 24:
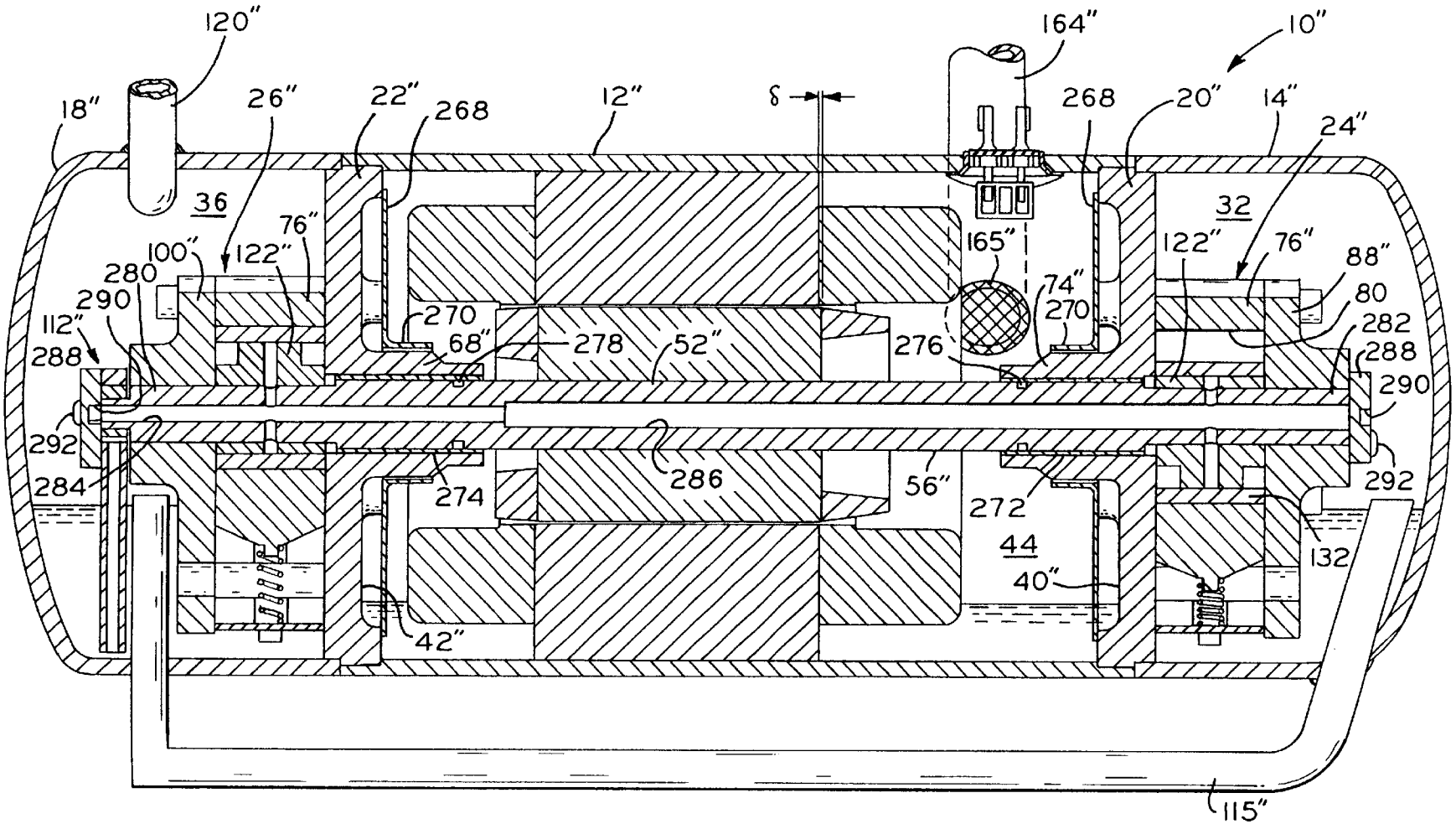
FIG. 24 is a sectional side view of the third embodiment of a compressor assembly according to the present invention, also showing the cross-over tube fluidly connecting the two discharge chambers and the compressor assembly discharge tube.

Referring to FIG. 24, a third embodiment of the twin rotary compressor assembly 10" is shown and is similar to the first embodiment compressor assembly 10 except as identified hereinbelow. Refrigerant gases, at suction pressure, flow into tube 164" through filter 165" and into suction chamber 44. Chamber 44, as in the first embodiment, is the suction chamber wherein the motor assembly 46 is immersed in relatively cool refrigerant gases. Following introduction into suction chamber 44, refrigerant then flows through identical suction mufflers 268, fastened to front and rear main bearings 20", 22" respectively, as shown. Suction mufflers 268 are thin metallic or plastic discs, overlaying axial surface 40" of the front bearing 20" and surface 42" of the rear bearing 22" Suction mufflers 268 have collar portions 270, which are slightly larger in diameter than hubs 68" and 74" to allow refrigerant gases to pass therebetween. Each suction muffler 268, acts to slow down the refrigerant gases entering each compressor mechanism to alleviate and attenuate noise otherwise manifested by free flowing refrigerant gases. Similar to the operations of the first embodiment compressor assembly 10, as previously described above, compressor assembly 10" compresses refrigerant in compressor assemblies 24" and 26" and discharges the compressed gases into front discharge chamber 32 and rear discharge chamber 36 through front and rear outboard bearings 88" and 100", respectively. The discharge gases carrying fluid-borne noise are muffled by first housing portion 14" and second housing portion 18". Discharge gases within chamber 32, as well as discharge gases from chamber 36, communicate via external cross-over tube 115". The merged discharge gases are then dispersed through the discharge tube 120" exiting the housing 12" of the compressor assembly 10".

The compressor assembly 10" supports shaft 52" at two locations, namely, a front portion 282 and a rear portion 280. At the front portion 282 of the shaft 52", the supporting structure includes the front main bearing 20" wherein the front main bearing 20" includes a bushing 272 which contacts the large diameter portion 56" of the front portion 282 of the shaft 52". Likewise, at the rear portion 280 of the shaft 52", the rear main bearing 22" supports the shaft 52" through rear bushing 274. The shaft 52" freely rotates within the front and rear bearings, however, endwise movement of the shaft 52" is restrained by common cover plate 288. Cover plates 288 mount to the front outboard bearing 88" and the rear outboard bearing 100", each secured by a pair of screws 292, to restrain endwise movement of the shaft 52".

Figure 25:
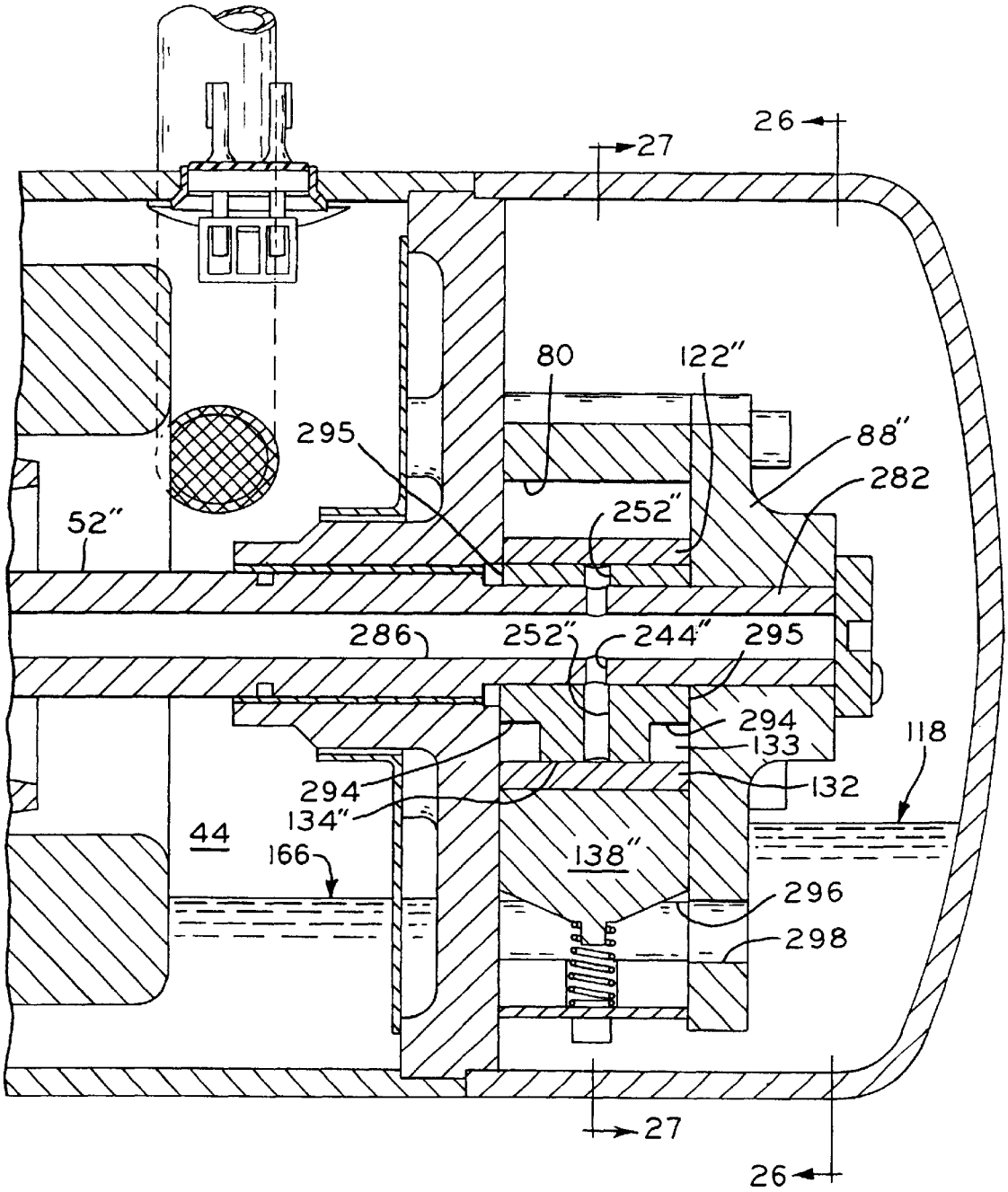
FIG. 25 is an enlarged fragmentary sectional side view of the front portion of the compressor assembly shown in FIG. 24.

Referring now to FIG. 25, orientation of shaft 52", eccentric 122" and roller piston 132, and additionally, lubrication thereof, will now be discussed. The crossbore 252" in eccentric 122" aligns with the crossbore 244" in the front portion 282 of the shaft 52" to allow oil to flow to the roller piston 132. Oil travels through bore 286', down the centerline of the shaft 52", entering crossbore 244" and crossbore 252" of eccentric 122" to coat the inner surface 133 of the roller piston 132. Eccentric 122" includes a pair of reliefs 294 along the outer surface 134" of the eccentric 122" in order to increase oil flow to the inner surface 133 of the roller piston 132 as well as a pair of axial faces 295 of the eccentric 122". Also shown is outboard bearing 88" having an oil passageway 298, well below oil level 118 so that vane 138" reciprocating between vane slot surfaces 296 are well saturated in oil to prevent refrigerant gas blow-by.

Figure 26:
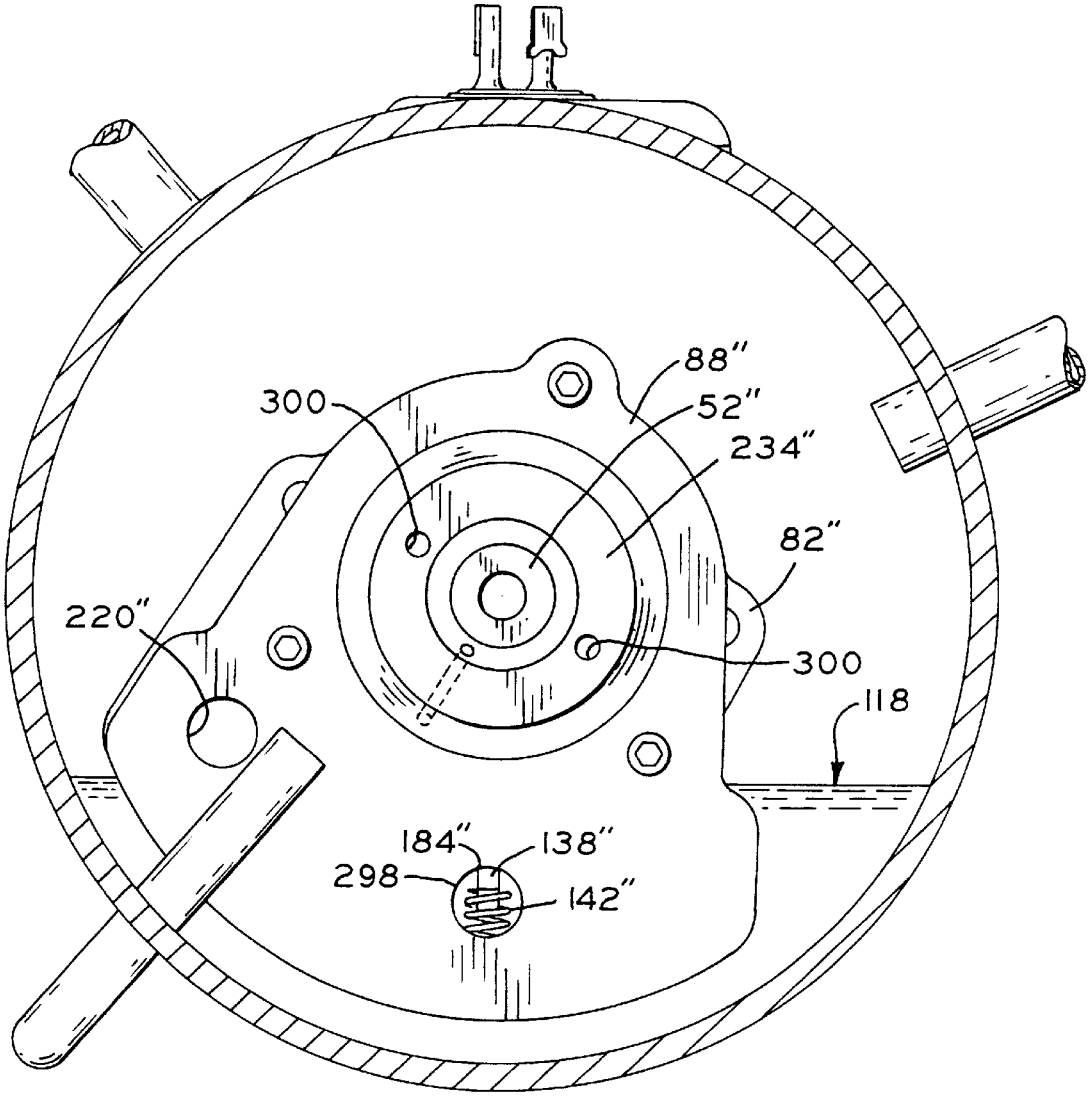
FIG. 26 is a sectional rear view of the compressor assembly shown in FIG. 25, taken along line 26—26 thereof.

Referring to FIG. 26', the outboard bearing 88" includes a raised portion 234", the discharge port 220", and the oil passageway 298. The raised portion 234" of the outboard bearing 88" also includes threaded holes 300 to fasten cover plates 288 thereto. Oil passage 298 in outboard bearing 88" is shown well below oil level 118 allowing oil to enter passageway 298 and generally saturate vane 138" and vane slot 184" in oil. Discharge port 220" is shown well above oil level 118 so that under normal operation of the front compressor mechanism 24" oil does not create a back pressure and refrigerant gases may freely exit discharge port 220".

Figure 27:
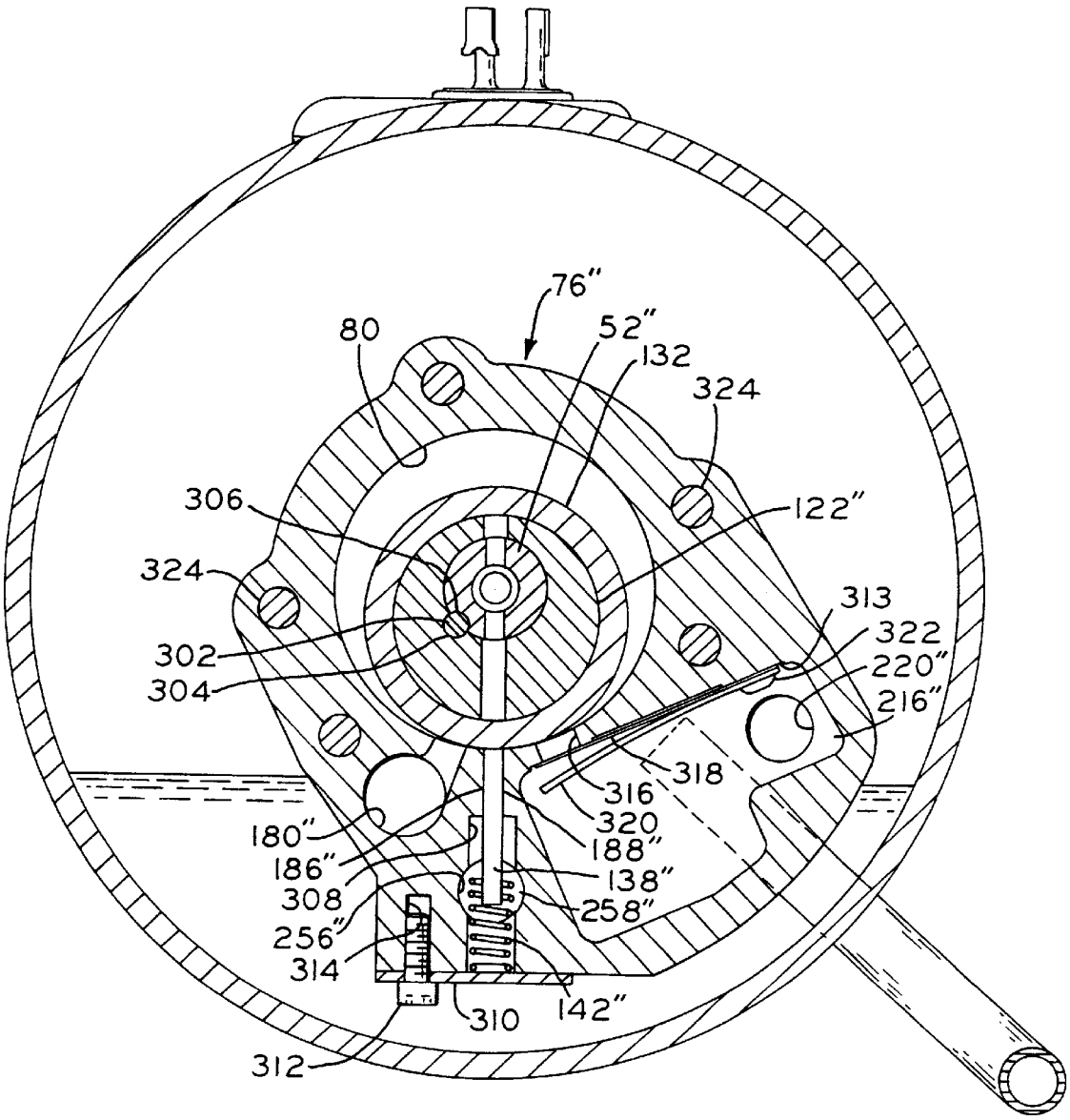
FIG. 27 is a sectional front view of the compressor assembly shown in FIG. 25, taken along line 27—27 thereof.
Figure 42:
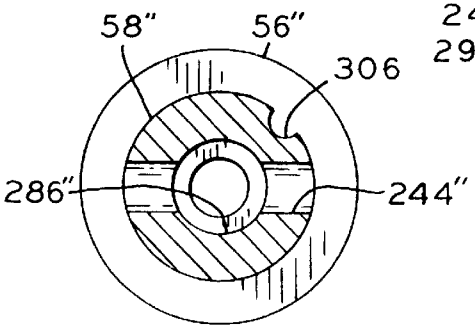
FIG. 42 is an enlarged sectional front view of the shaft shown in FIG. 40, along line 42—42 thereof.
Figure 43:
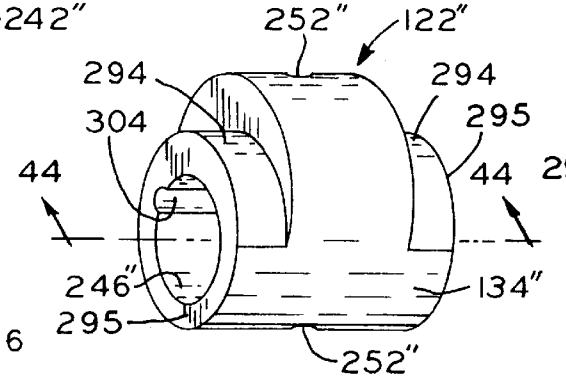
FIG. 43 is a front perspective view of an eccentric of the compressor assembly as shown in FIG. 24.
Figure 44:
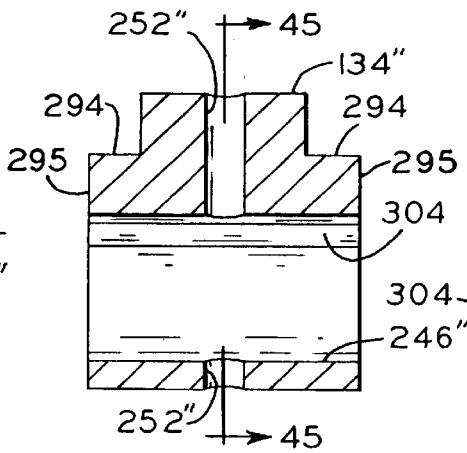
FIG. 44 is a sectional side view of the eccentric shown in FIG. 43, along line 44—44 thereof.
Figure 45:
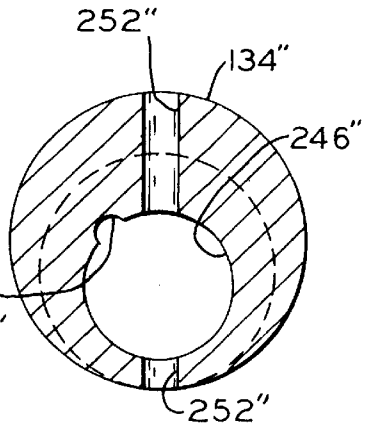
FIG. 45 is a sectional end view of the eccentric shown in FIG. 44, along line 45—45 thereof.

Referring to FIG. 27, within the front compressor mechanism 24" is shown the roller piston 132, the eccentric 122" and the shaft 52" wherein the eccentric 122" is pinned to the shaft 52". The rear compressor mechanism 26" involves an identical configuration in that the eccentric 122" is thereby pinned to the shaft 52". Momentarily referring to FIG. 42, there is seen a groove 306 in the shaft 52" receiving a pin 302 (FIG. 27) and further, as shown in FIGS. 43–45 there is a groove 34 in the eccentric 122" that receives the pin 302, thereby securing the eccentric 122" to the shaft 52".

Referring again to FIG. 27, and more specifically the area about vane 138", vane 138" is shown in vane slot 184" and held in contact with the roller piston 132 by biasing member or spring 142". Spring 142" is restrained within a spring cavity 308 by a cover 310 and cover 310 is secured by screw 312. Screw 312 is threaded into hole 314 which is within cylinder block 76". Scallops 256" and 258" can be seen disrupting spring cavity 308 as scallops 256" and 258" are continuous along the width of cylinder block 76". Cylinder block 76" includes an inner wall 313 defining a portion of the discharge cavity 216" wherein a reed valve 318 and retainer 320 are secured. Reed valve 318 and retainer 320 operate by allowing compressed discharge gases to escape the cylindrical cavity 80, and in addition, to keep discharge gas from flowing back into the cylindrical cavity 80. The reed valve 318 and the retainer 320 are secured to the cylinder block 76" by way of a pair of threaded fasteners 322.

Figure 28:
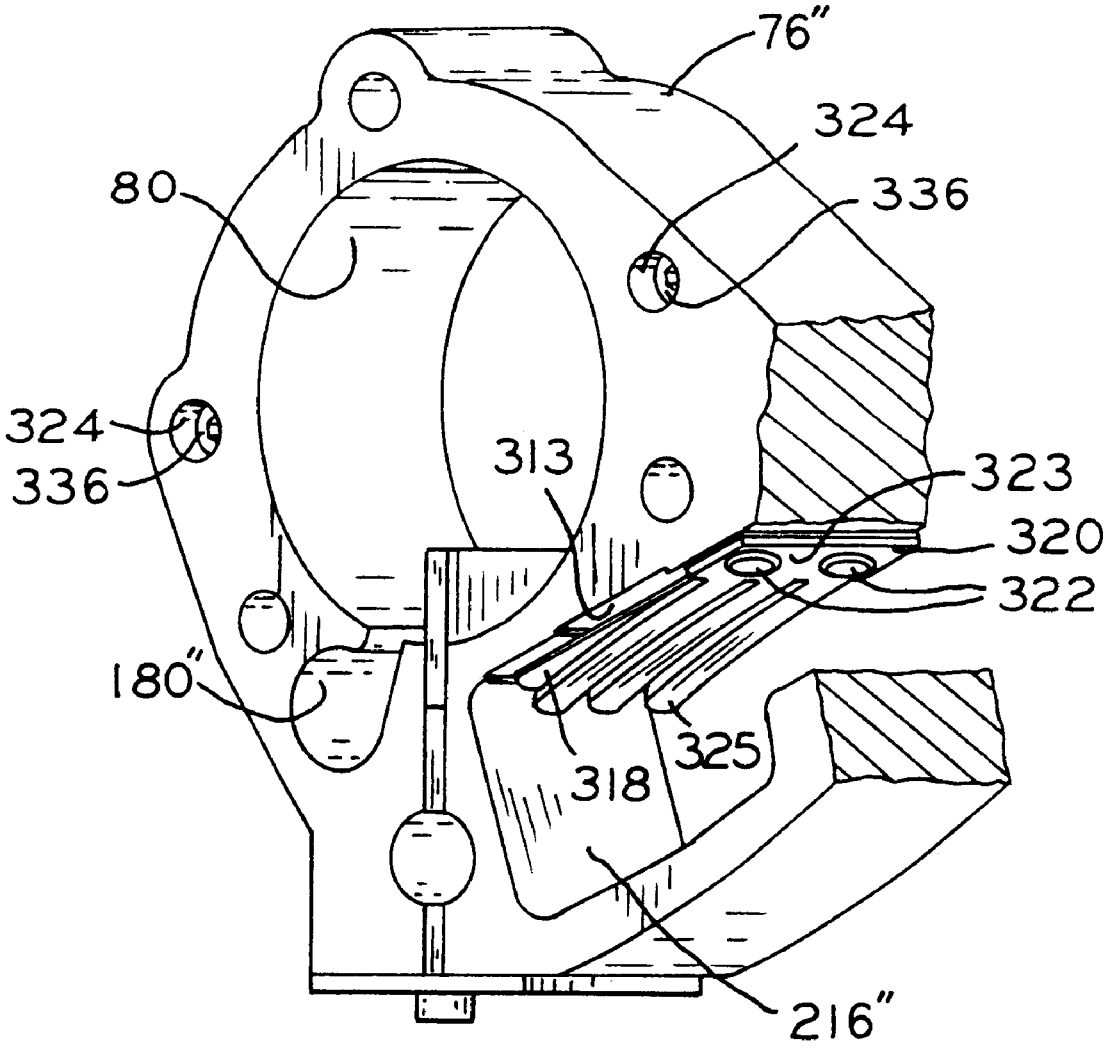
FIG. 28 is a fragmentary perspective of a common cylinder block of the compressor assembly shown in FIG. 24, including the reed valve assembly and extended vane.
Figure 35:
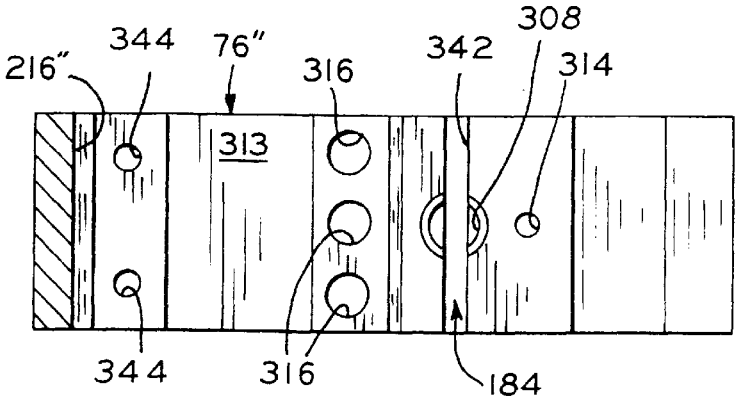
FIG. 35 is a sectional bottom view of the cylinder block of FIG. 34, along line 35—35 thereof.

Referring to FIG. 28, the retainer 320 and the corresponding reed valve 318 include three individual fingers which correspond with three discharge openings 316 (FIG. 35). The retainer 320 has a first end 323 which is secured by fasteners 322 and a second end 325 including the three fingers extending therefrom. The three fingers of the retainer 320 overlay the three discharge openings 316. Corresponding reed valve is sandwiched between the retainer 320 and inner wall 323. Each finger of the retainer is held away from the inner wall 313 and acts as a stop for each corresponding finger of the reed valve 318. Pressure within the cylindrical cavity 80 increases until the fingers of the reed valve are displaced and cylinder pressure is alleviated. The fingers of the reed valve 318 return to their original position overlaying the inner wall 313 when cylinder chamber pressure is sufficiently decreased. The retainer 320 may be made of a metallic material or a suitable rigid, high temperature plastic. The reed valve 318 may be made of a metallic material or a suitable high temperature polymer. Also shown in FIG. 28 are a pair of bolt holes 324 which receive bolts 336 to fasten cylinder block 76" to the front main bearing 20" and the rear main bearing 22".

Figure 29:
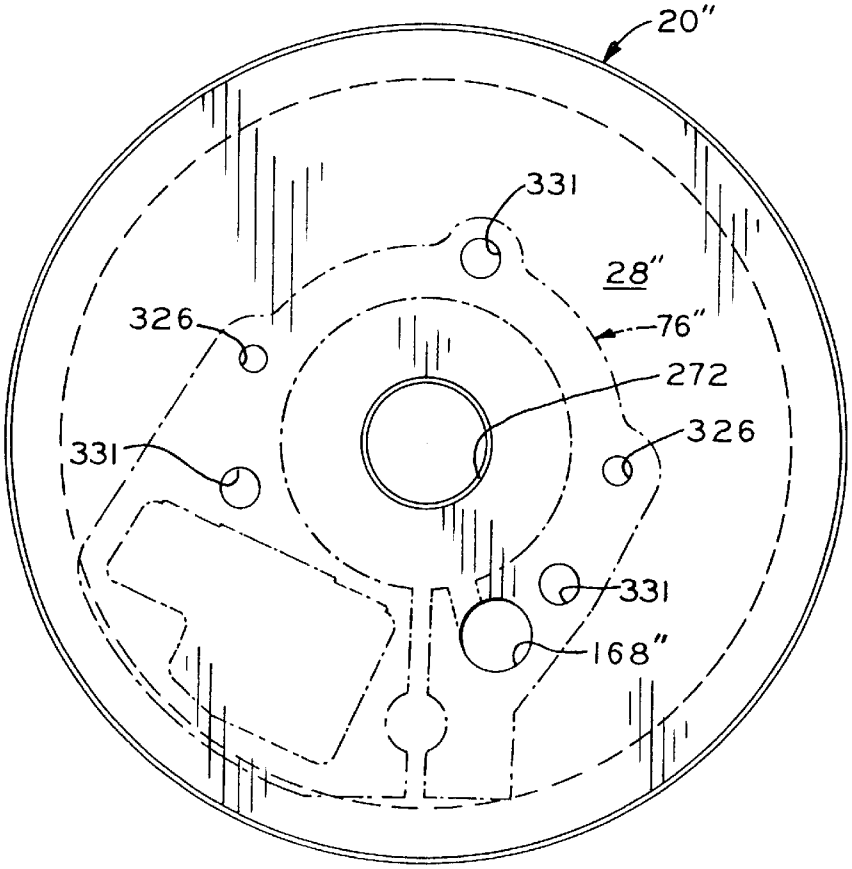
FIG. 29 is a front view of the front main bearing of the compressor assembly shown in FIG. 24, including the outline of the cylinder block location on the axial main bearing surface.

Referring now to FIG. 29, outboard bearing 20" includes control surface 28" which serves as a partition to separate discharge chamber 32 from suction chamber 44. Main bearing 20" includes the pair of holes 326 that receive the bolts 336 (not shown) to fasten the cylinder block 76" to control surface 28" of the main bearing 20". The main bearing 20" also includes three threaded holes 331 which receive three threaded fasteners or bolts 90 (not shown) to secure not only the cylinder block 76" but the outboard bearing as well. Suction port 168" is a continuous hole through bearing 20" and aligns with the suction portion of cylinder block 76".

Figure 30:
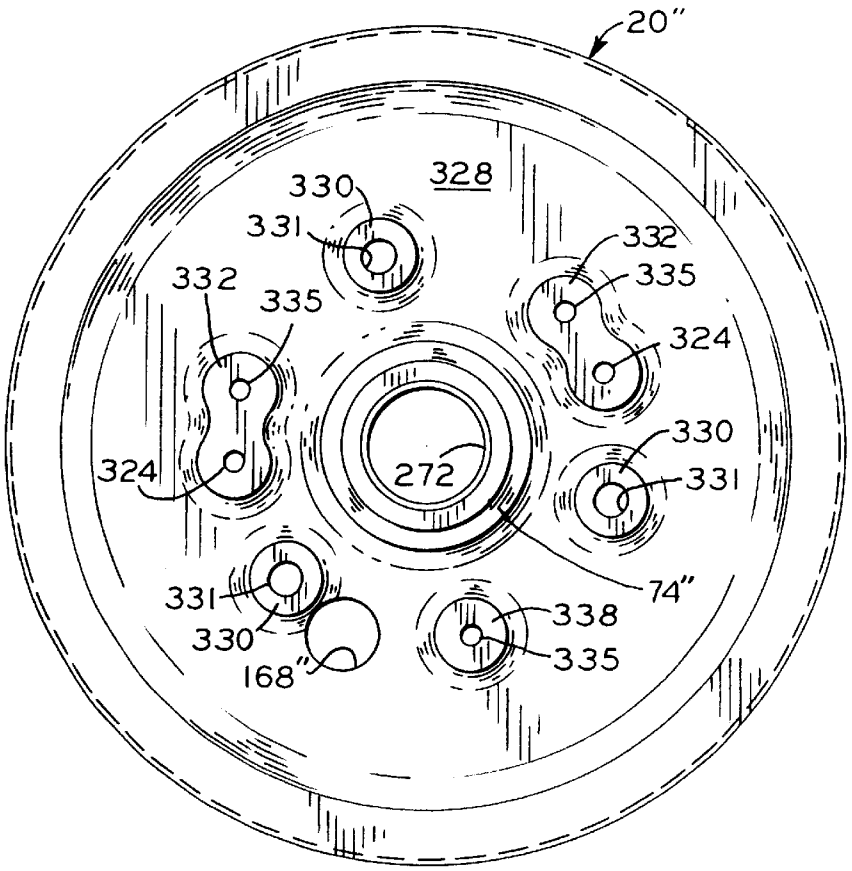
FIG. 30 is a rear view of the main bearing shown in FIG. 29.

Referring now to FIG. 30, the side opposing control surface 28" of main bearing 20" is shown including a well portion 328 and several raised portions thereon. Three distinct and equally radially displaced raised portions 330 include threaded holes 331 which receive bolts 90 (not shown) to clamp the cylinder block 76" between the front main bearing 20" and the front outboard bearing 88" (not shown). A pair of raised portions 332 include a first set of threaded holes 324 to receive bolts 326 in mounting the cylinder block 76" to the front main bearing 20". A second set of threaded holes 335 are included in raised portions 332 and receive screws 334 (not shown) to hold the suction muffler 268 thereagainst. The final raised portion 338 also includes threaded hole 335 to secure the suction muffler 268 in a third location to the front main bearing 20". The front main bearing 20" also includes suction port 168" aligning with the suction port 180" of the cylinder block 76" and bushing 272, within the center portion of front main bearing 20" and supporting shaft 52".

Figure 32:
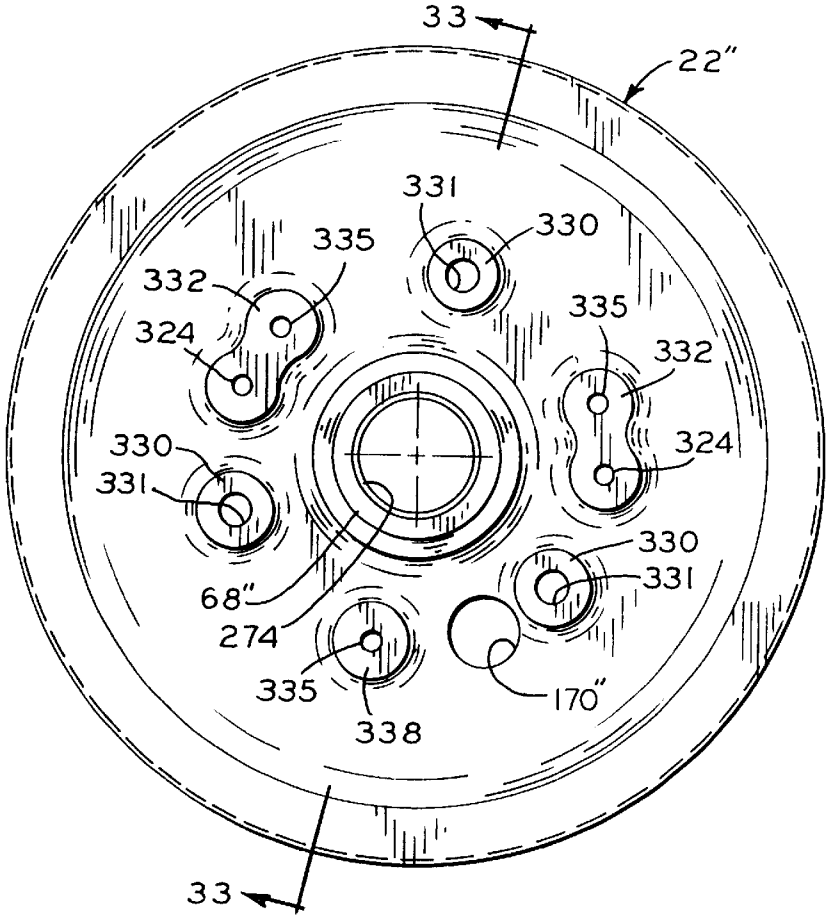
FIG. 32 is a front view of the main bearing shown in FIG. 31.
Figure 31:
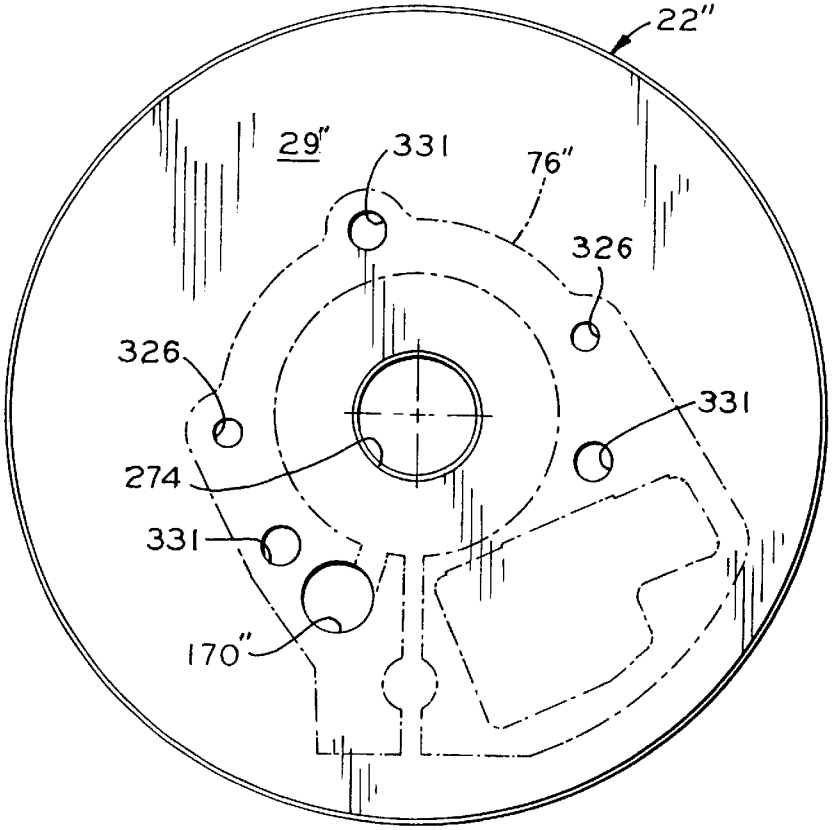
FIG. 31 is a rear view of the rear main bearing of the compressor assembly shown in FIG. 24, including the outline of the cylinder block location on the axial main bearing surface.
Figure 33:
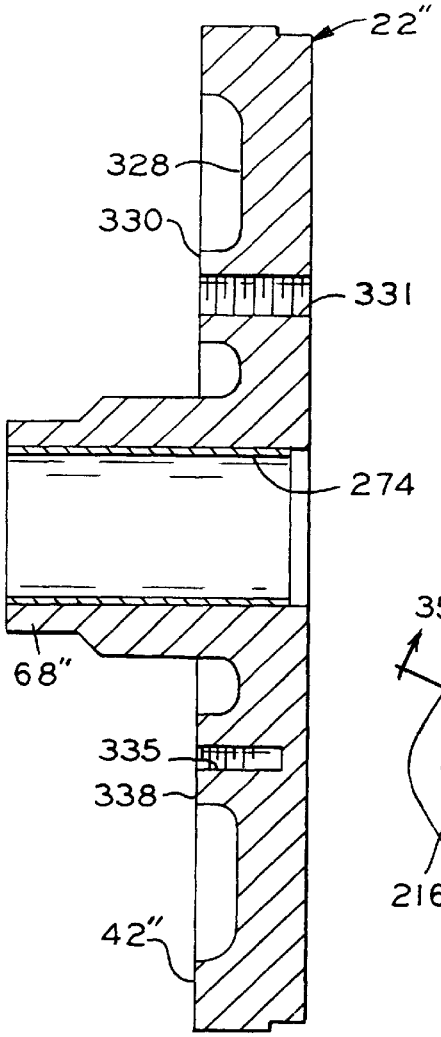
FIG. 33 is sectional side view of each of the main bearings shown in FIGS. 30 and 32, along lines 33—33 thereof.

Referring to FIG. 31 and front main bearing 20" in FIG. 29, rear main bearing 22" is a mirror image of 20". Rear main bearing 22" includes a control surface 29" which encloses discharge chamber 36 and separates discharge chamber 36 from suction chamber 44. Rear main bearing 22" includes a pair of threaded holes 326 to secure cylinder block 76", and in addition, three threaded holes 331 which fasten the rear outboard bearing 100" to the rear main bearing 22" sandwiching the cylinder block 76" therebetween. The rear main bearing 22" also includes a hole therethrough 170" aligned within suction port 180" of cylinder block 76" to allow suction gases within chamber 44 to enter cylinder block 76" in the rear compressor mechanism 26". Referring now to FIG. 32, the rear main bearing 22" is a mirror image of front main bearing 20", as shown in FIG. 30, and its 'structure' and operation is similar thereto. Referring now to FIG. 33, rear main bearing 22" includes through holes 331 to receive bolts 90 (not shown) fastening rear outboard bearing 100" to rear main bearing 22". A second hole 335 is shown, which does not continue through the width of the rear main bearing 22". A portion of hole 335 is threaded to receive a fastener 334 to secure the suction muffler 268 to the axial surface 42" of rear main bearing 22".

Figure 34:
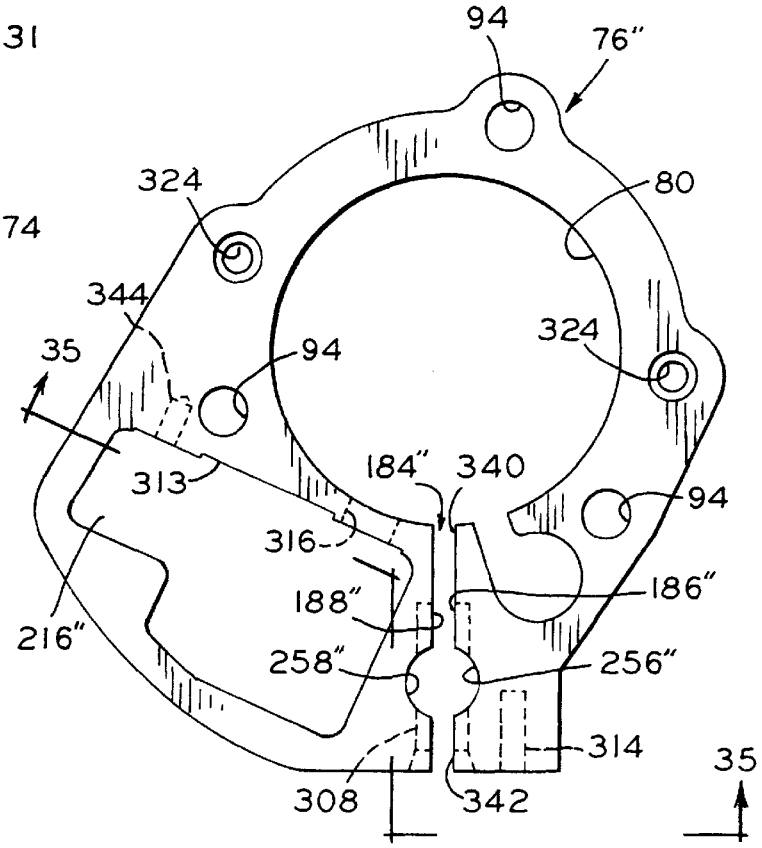
FIG. 34 is a front view of the common front and rear cylinder block of the compressor assembly shown in FIG. 24.

Referring now to FIG. 34, a common cylinder block 76" of the third embodiment is shown. The vane slot 184" includes an upper portion 340 and a lower portion 342. The upper portion 340 of the vane slot 184" includes the surfaces 296 contacting the vane 138", whereas during compressor assembly 10" operation, the lower portion 342 of the vane slot 184" does not contact vane 138". The upper portion 340 of the vane slot 184" is separated from the lower portion 342 by scallops 256" and 258", respectively. Cylinder block 76" includes holes 94 which facilitate outboard bearing bolts 90 (not shown) and additionally, holes 324 to facilitate cylinder block screws 334 (not shown).

Referring to FIG. 35, cylinder block 76" includes the inner wall 313 partially defining the discharge cavity 216" which accommodates the retainer 320 and reed valve 318. More specifically, a pair of holes 344 include threads which receive a pair of screws 322 (FIG. 28) to secure the retainer 320 and reed valve 318. Also, within inner wall 313 are three discharge openings 316 which fluidly connect discharge cavity 216" to cylindrical cavity 80. Discharge openings 316 in inner wall 313 are overlayed by the three fingers of the reed valve 318 (FIG. 28). Cylinder block 76" also includes a spring cavity having a suitable depth to receive an adequate sized spring, such as spring 142" (FIG. 27), however leaving enough cylinder block material to form an adequately supportive vane slot for the vane 138".

Figure 36:
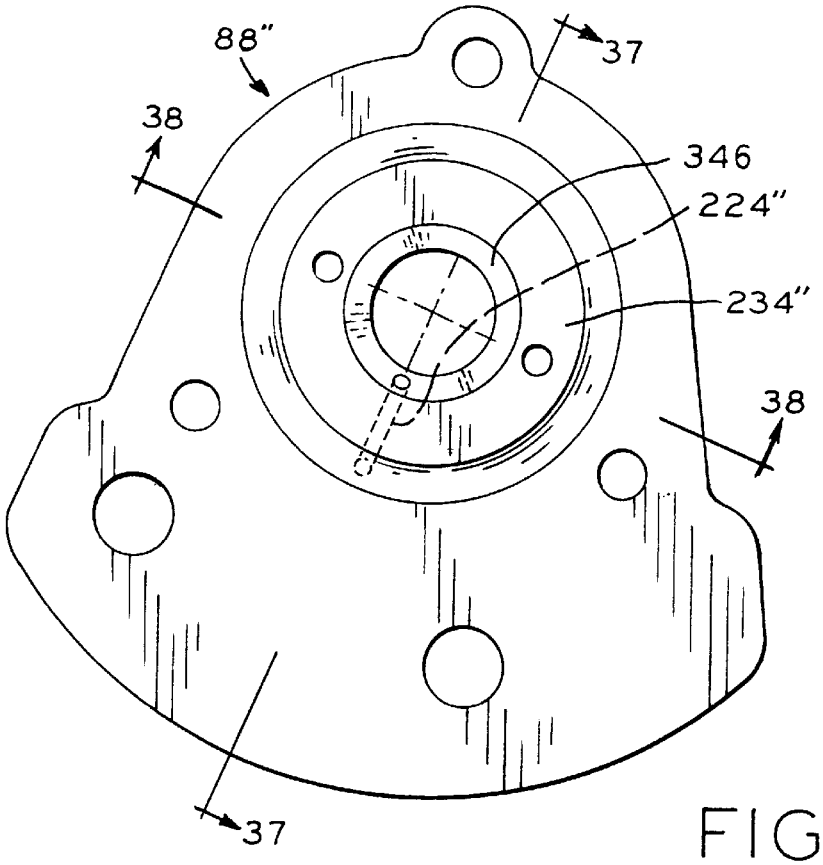
FIG. 36 is a front view of the front outboard bearing of the compressor assembly shown in FIG. 24.
Figure 37:
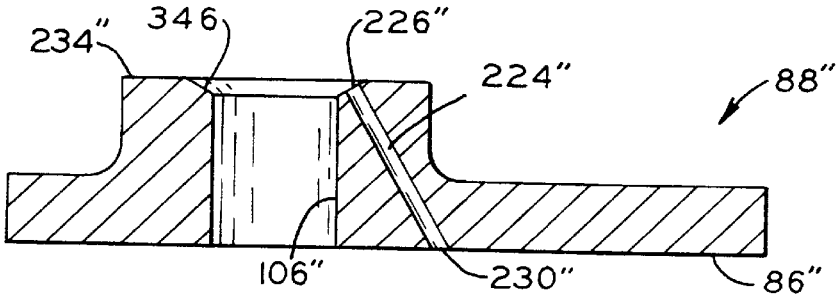
FIG. 37 is a sectional side view of the outboard bearing of FIG. 36, along line 37—37 thereof.
Figure 38:
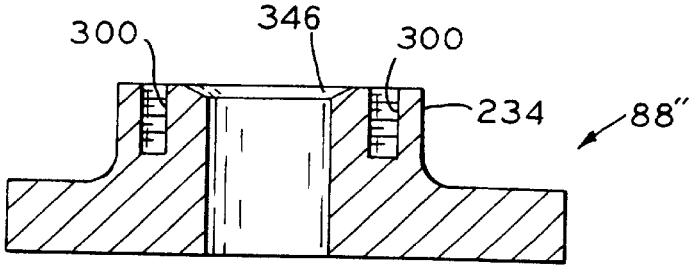
FIG. 38 is a sectional side view of the outboard bearing of FIG. 36, along line 38—38 thereof.

Referring to FIGS. 36–38, there is shown the front outboard bearing 88" and more specifically the oil conduit 224" contained therein. FIG. 37 displays oil conduit 224" having a conduit inlet 226" at chamfer 346 extending diagonally through the width of the outboard bearing 88", and exiting at conduit outlet 230" of the axial surface 86". Conduit outlet 230" is positioned within an interior portion of the cylindrical cavity 80 to expose front portion 282 of shaft 52" to a lower pressure than rear portion 280 of shaft 52". This pressure difference acts to draw oil from rear portion 280 of shaft 52" to front portion of shaft 52" through bores 284 and 286, respectively (FIG. 24). This "rear to front" migration of oil through shaft 52" ensures oil is introduced into cylindrical cavities 80 for proper lubrication of the roller piston 132" and surfaces defining the cylindrical cavity 80. FIG. 38 displays the pair of holes 300 which threadably receive screws 292 to secure cover plate 282 in restraining endwise movement of shaft 52".

Figure 39:
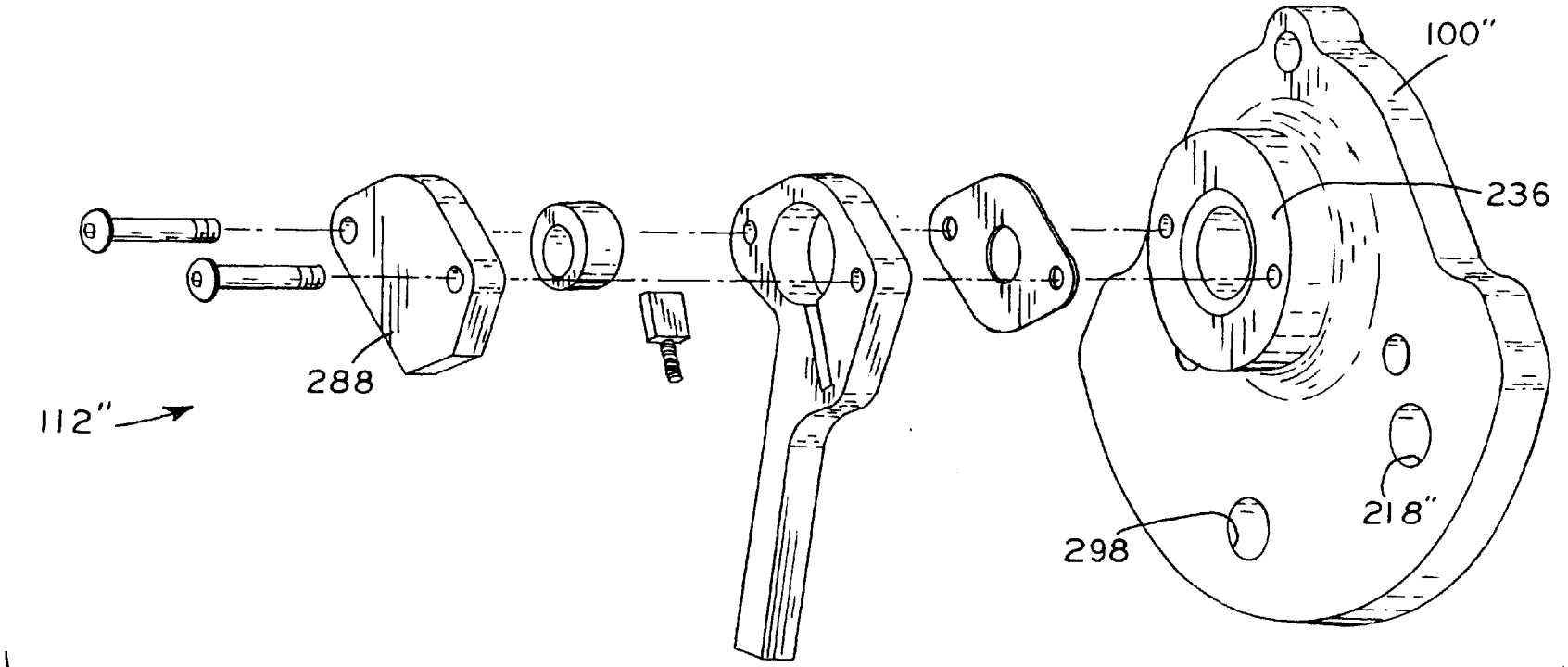
FIG. 39 is an exploded view of the pump assembly and rear outboard bearing of the present invention shown in FIG. 24.
Figure 40:
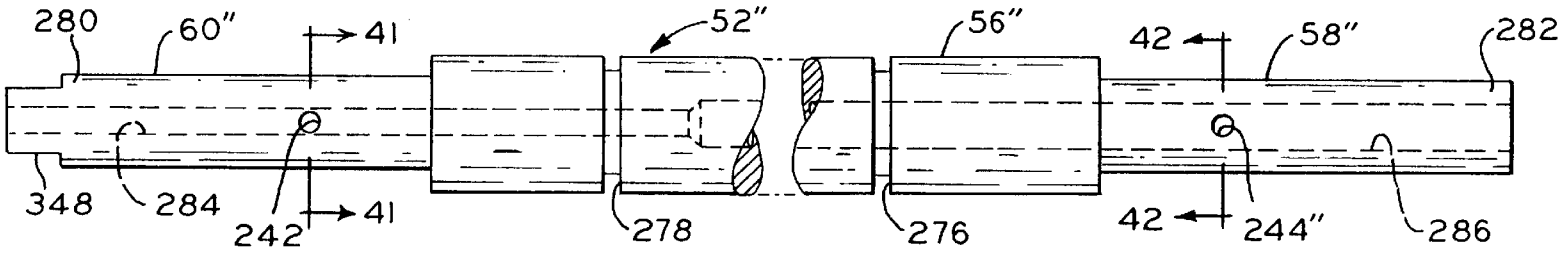
FIG. 40 is a partial sectional side view of the shaft of the compressor assembly shown in FIG. 1.
Figure 41:
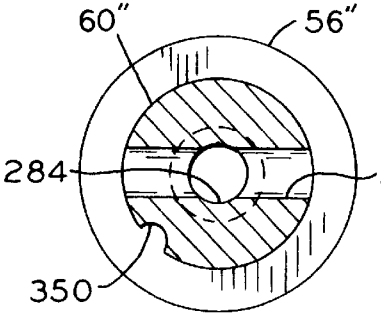
FIG. 41 is an enlarged sectional rear view of the shaft shown in FIG. 40, along line 41—41 thereof.

Referring to FIG. 39, rear outboard bearing 100" is shown with the oil pump assembly 112". Rear outboard bearing 100" includes two through holes: the oil passageway 298 and discharge port 218". Referring now to FIGS. 40–42, shaft 52" includes the front portion 282 and the rear portion 280 coinciding with the front and rear ends of the compressor assembly 10". A center portion of the shaft includes a surface 56" which is in rotational contact with the front bushing 276 and the rear bushing 278. On shaft 52" are a pair of O-ring grooves 276 and 278, respectively, which receive O-rings (not shown). O-ring grooves 276 and 278, respectively, serve to separate the suction chamber pressure within suction chamber 44 from the discharge chamber pressure in front chamber 32 and rear discharge chamber pressure in rear chamber 36. Shaft 52" includes a large diameter inner bore 286 and a somewhat smaller bore 284 extending through the rear portion 280 of the shaft 52". Cross bore 242" allows oil, being drawn from the rear portion 280 of the shaft, into eccentric 122", similarly, cross bore 244" allows oil being drawn from the rear portion 280 of the shaft 52" and into eccentric 122" positioned at the front portion 282 of the shaft 52".

Referring to FIG. 41, crossbore 242" is shown intersecting through bore 284 to facilitate the migration of oil into eccentric 122". Also shown is surface 60" including a disruption thereon in the form of a pin groove 350. Referring to FIG. 42, the front portion 282 of the shaft 52" includes outer surface 56", front small diameter portion 58" and pin groove 306 thereon. Crossbore 244" intersects inner bore 286 to welcome oil migration into the eccentric 122" attached thereto (not shown).

Referring now to FIGS. 43–45, eccentric 122" includes a pair of reliefs 294 and inner bore 246" formed continuously through and a pin groove 304 therealong. During operation of the compressor 10", oil moves through passageway 252" towards the outer surface 134" of eccentric 122" coating the outer surface 134" as well as the inner surface 133 of the roller piston 132. The pair of reliefs 294 facilitate optimum lubrication of axial faces 295 of the eccentric 122".

Figure 46:
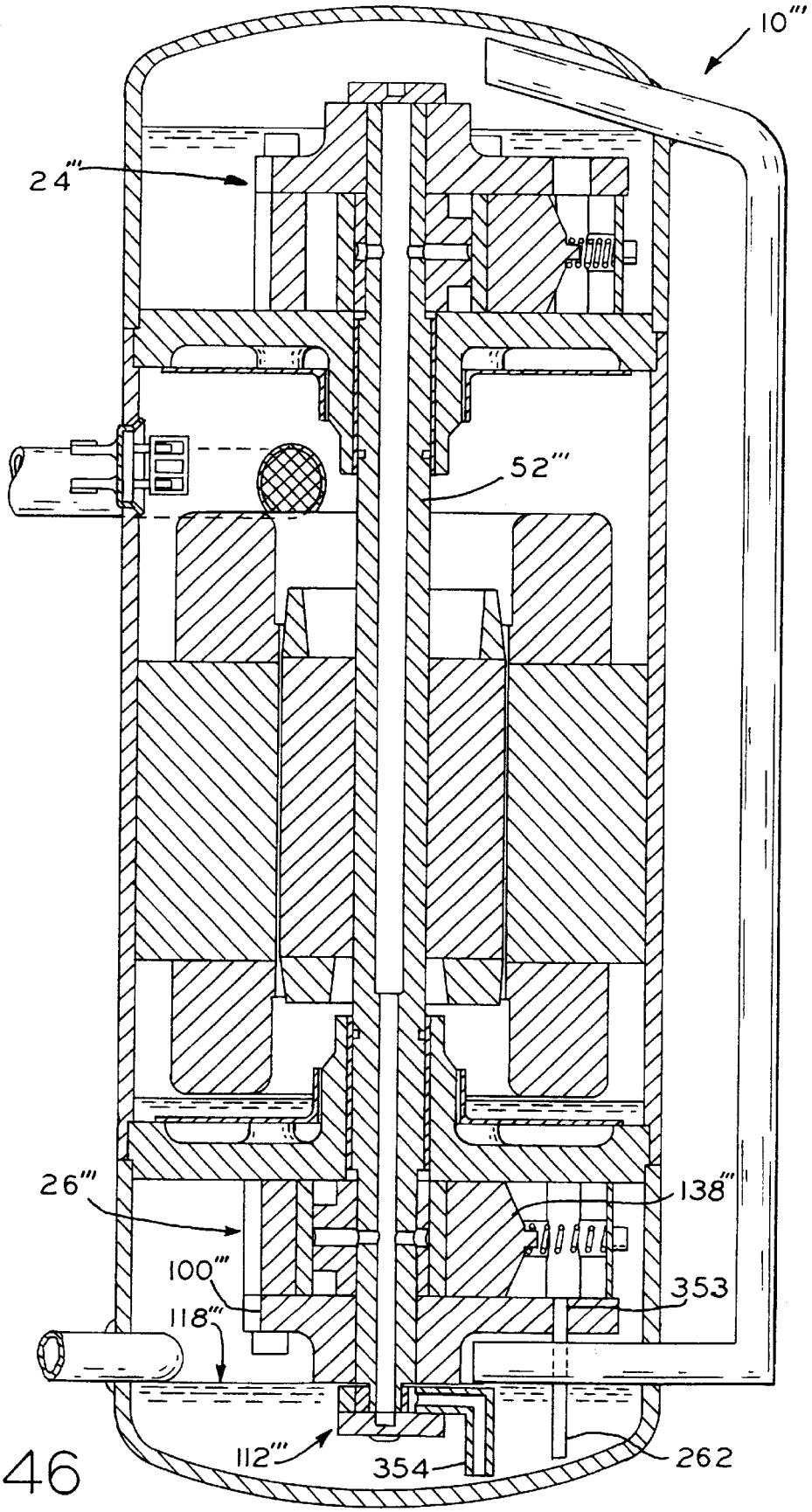
FIG. 46 is a sectional side view of a fourth embodiment of a compressor assembly according to the present invention, also showing the cross-over tube fluidly connecting the two discharge chambers and the compressor assembly discharge tube.

Referring now to FIG. 46, a fourth embodiment of the compressor assembly 10" of the present invention is shown and is similar in many aspects to the third embodiment 10", however, vertically oriented. The compressor assembly 10" includes a lower compressor mechanism 26" having an oil suction tube 262" sealably fitting into an oil passageway 353 in lower outboard bearing 100" to draw from oil level 118" and lubricate the vane 138". Also included in this particular embodiment is an elbowed pump intake conduit in the form of a tube 354 within the oil pump assembly 112" to draw oil vertically and into the lower portion 280 of the shaft 52". The oil level in the upper discharge chamber, nearing the discharge port, becomes an undesirous source of backpressure if such level exceeds the discharge port, however, nonetheless depicted to set forth that the reed valve 318 (FIG. 28), within the cylinder block, may suffice as an oil barrier to block excessive amounts of oil attempting to enter the cylindrical cavity via the discharge port.

Figure 47:
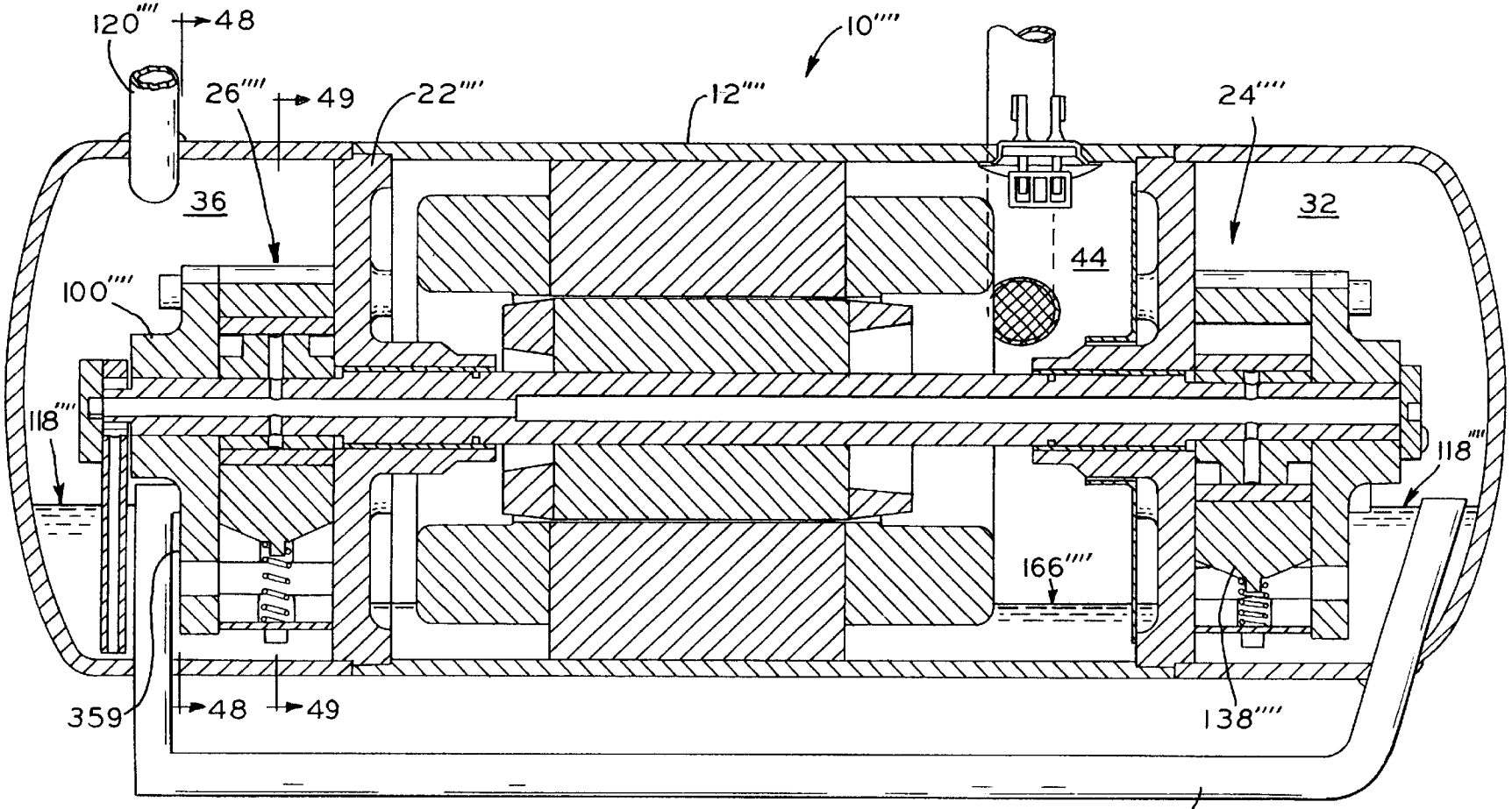
FIG. 47 is a sectional side view of a fifth embodiment of a compressor assembly according to the present invention, showing the suction tube fluidly connecting a discharge of one of the compressor mechanisms to a suction port of the remaining compressor mechanism and the compressor assembly discharge tube.

Referring to FIG. 47, yet another embodiment, the fifth embodiment of the present invention compressor assembly 10'", discloses a cascaded compressor assembly, or series configuration, such that general operation can be described as follows: a first compressor mechanism 24'" compresses refrigerant gas to an intermediate pressure stage and discharges such pressurized gas to a second compressor 26'", via an suction tube 356, wherein the final discharge pressure is obtained. More specifically, refrigerant gas is introduced at a suction pressure within suction chamber 44 and thereafter is suctioned into front compressor 24'", exclusively. The gas at suction pressure is then compressed to an intermediate pressure and dispersed within discharge chamber 32. Thereafter, the refrigerant gas at intermediate suction pressure and within discharge chamber 32 is extended through suction tube 356. Suction tube 356 is in exclusive communication with an suction port 358 located on an axial surface 359 of the outboard bearing 100'" of the rear compressor mechanism 26'". The intermediate stage refrigerant gas, supplied to compressor 26'" by suction tube 356, is further compressed and discharged into discharge chamber 36. The discharged refrigerant, at the secondary or maximum pressure, within chamber 36 exits the compressor housing 12'" through discharge tube 120'".

Figure 48:
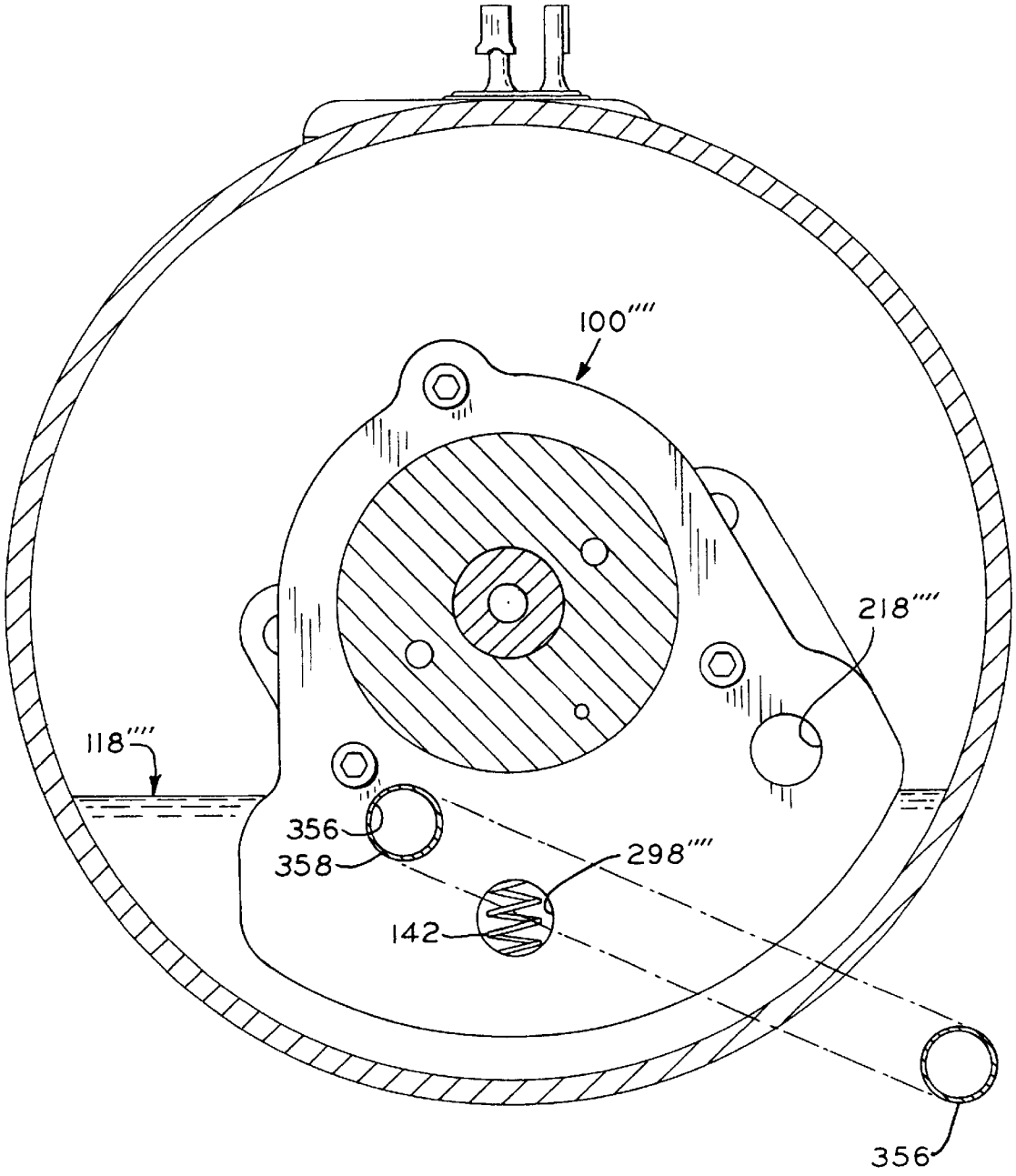
FIG. 48 is a sectional rear view of the compressor assembly shown in FIG. 47, taken along line 48—48 thereof.
Figure 49:
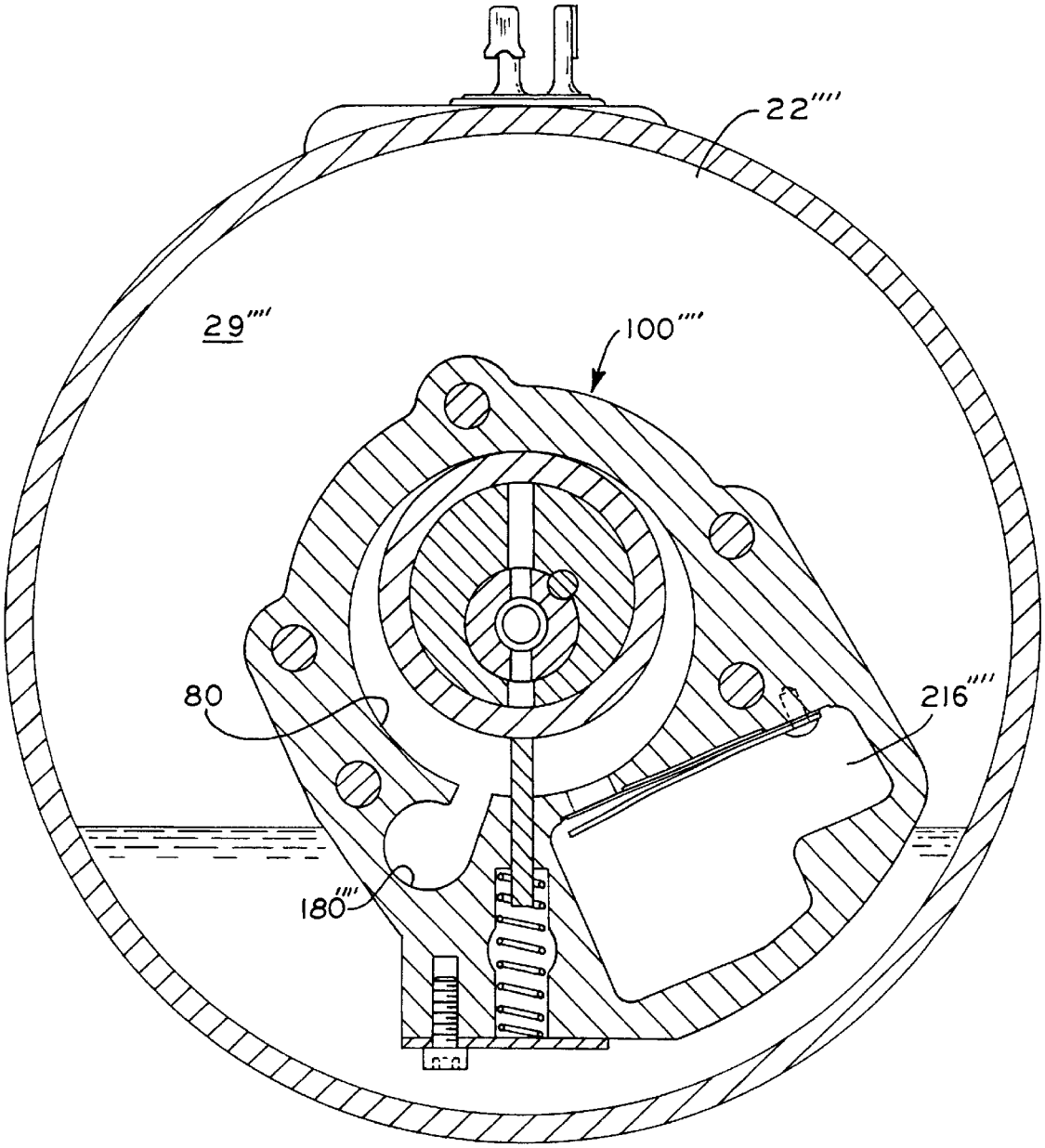
FIG. 49 is a sectional rear view of the compressor assembly shown in FIG. 47, taken along line 49—49 thereof.

Referring to FIG. 48, the rear outboard bearing 100'" has an suction port 358, sealably receiving the suction tube 356, the oil passageway 298'" and the discharge port 218'". Once again, oil level 118'" substantially covers the vane 138'" and vane slot 134'" (see also FIG. 47). However, it can be seen care is taken to avoid oil level to reach discharge port 218'". Suction port 358 seals around suction tube 356 therefore an oil level 118'" substantially thereover the suction port 358 will not hinder operation of the compressor assembly 10'" whatsoever. Referring to FIG. 49, main bearing 22'" has control surface 29'" with cylinder block 76'" attached thereto. However, in contrast to the previously hereinabove described compressor assembly embodiments, compressor assembly 10'" includes the main bearing 22'" which does not fluidly communicate with the suction chamber 44.

While this invention has been described as having exemplary designs, the present invention may be further modified within the spirit and scope of this disclosure. Therefore, this application is intended to cover any variations, uses, or adaptations of the invention using its general principles. For example, aspects of the present invention may be applied to single cylinder rotary compressors. Further, this application is intended to cover such departures from the present disclosure as come within known or customary practice in the art to which this invention pertains.

What is claimed is:

1. A hermetic rotary compressor assembly, comprising:

a horizontally arranged housing;

a main bearing disposed in said housing and subdividing said housing into a discharge chamber and a suction chamber, said main bearing including a suction port therethrough and a lubricant intake passage disposed therein, said lubricant intake passage being positioned radially between said suction port and said housing and in fluid communication with said suction chamber;

a cylinder block and bearing assembly in said housing, said cylinder block and bearing assembly defining a cylindrical cavity;

a roller piston disposed in said cavity;

a motor drivingly coupled to said roller piston and disposed in said suction chamber;

said cylinder block having a vane slot extending axially through said cylinder block and extending radially from an outside perimeter surface of said cylinder block to said cylindrical cavity; and at least a portion of said slot defined by a pair of substantially parallel sidewalls, a vane disposed in said slot and urged against said roller piston, said vane guided by said substantially parallel sidewalls, there being a clearance between said vane and said substantially parallel sidewalls; and said discharge chamber comprising a sump in which a pool of liquid lubricant is disposed, a lower portion of said vane and said clearance immersed in said liquid lubricant, whereby said vane is lubricated and a refrigerant gas seal is established between said clearance and said vane;

wherein liquid lubricant accumulated in said suction chamber is transported through aspiration from said lubricant intake passage to said suction port.

2. The compressor assembly of claim 1, wherein a substantial portion of said vane slot sidewalls are disposed below an upper surface of the pool of liquid lubricant.

3. The compressor of claim 1, wherein said vane slot extends completely axially through said cylinder block.

4. A hermetic rotary compressor assembly, comprising:

a housing;

a cylinder block and bearing assembly in said housing, said cylinder block and bearing assembly defining a cylindrical cavity;

a roller piston disposed in said cavity;

a motor drivingly coupled to said roller piston;

said cylinder block having a vane slot extending axially through said cylinder block and extending radially from an outside perimeter surface of said cylinder block to said cylindrical cavity;

at least a portion of said slot defined by a pair of substantially parallel sidewalls;

a vane disposed in said slot and urged against said roller piston, said vane guided by said substantially parallel sidewalls, there being a clearance between said vane and said substantially parallel sidewalls;

a discharge chamber comprising a sump in which a pool of liquid lubricant is disposed, a lower portion of said vane and said clearance immersed in said liquid lubricant, whereby said vane is lubricated and a refrigerant gas seal is established between said clearance and said vane;

a second rotary compressor mechanism axially disposed within a second discharge chamber in said housing, said second rotary compressor including a second cylinder block and bearing assembly defining a second cylindrical cavity and a second roller piston disposed in said second cavity;

a suction chamber disposed between said pair of compressor mechanisms, said second discharge chamber comprising a sump in which pool of liquid lubricant is disposed, said drive motor disposed axially intermediate said pair of compressor mechanisms and operably coupled to said roller pistons provided in each said cylinder block, said motor located in said suction chamber;

at least one of said compressor mechanisms being in fluid communication with said suction chamber; and a pair of discharge conduits connected with respective said discharge chambers through which discharge gases exit therefrom.

5. The compressor assembly of claim 4, wherein one of said pair of discharge conduits fluidly connects said pools of liquid lubricant in said discharge chambers.

6. The compressor assembly of claim 5, wherein said discharge chambers are at substantially the same discharge pressure.

7. The compressor assembly of claim 4, wherein the compressor assembly is horizontally oriented and said pool of liquid lubricant in each said sump is disposed in a lower portion thereof.

8. The compressor assembly of claim 7, wherein sidewalls of each said vane slot are substantially vertical.

* * * * *